US006368391B1

(12) United States Patent
O'Hara et al.

(10) Patent No.: US 6,368,391 B1
(45) Date of Patent: Apr. 9, 2002

(54) ELECTRONICALLY ENHANCED MEDIA AIR FILTRATION SYSTEM

(75) Inventors: William E. O'Hara, Jamesville; Richard T. Briggs, Kirkville; Max Bablok, Liverpool; Herbert Hildebrandt, Baldwinsville; Richard H. Chapman, Camillus; Robert S. Englert, Syracuse; Mark A. Ferguson, Syracuse; Timothy R. Fitch, Syracuse; Scott W. Osiecki, Skaneateles; Fred A. Marconi, Jr., Morrisville, all of NY (US)

(73) Assignee: Healthway Products Company, Inc., E. Syracuse, NY (US)

( * ) Notice: Subject to any disclaimer, the term of this patent is extended or adjusted under 35 U.S.C. 154(b) by 0 days.

(21) Appl. No.: 09/644,623

(22) Filed: Aug. 23, 2000

(51) Int. Cl.[7] ..... B03C 3/155

(52) U.S. Cl. ..... 96/18; 96/24; 96/26; 96/55; 96/63; 96/75; 96/81; 96/94

(58) Field of Search ..... 96/18–20, 24, 96/26, 55, 59, 63, 94, 75–77, 80–82

(56) References Cited

U.S. PATENT DOCUMENTS

| | | | | | |
|---|---|---|---|---|---|
| 895,729 | A | | 8/1908 | Cottrell | 95/73 |
| 2,116,509 | A | | 5/1938 | Cottrell | 204/181.9 |
| 2,579,440 | A | | 12/1951 | Palmer | 96/40 |
| 2,593,377 | A | | 4/1952 | Wintermute | 95/70 |
| 2,634,818 | A | | 4/1953 | Wintermute | 96/36 |
| 3,028,864 | A | | 4/1962 | Minto | 131/333 |
| 3,237,387 | A | | 3/1966 | Haugen et al. | 55/519 X |
| 3,392,509 | A | | 7/1968 | Pelosi, Jr. | 96/66 |
| 3,504,482 | A | * | 4/1970 | Goettl | 96/81 X |
| 3,537,238 | A | | 11/1970 | Dungler | 55/462 X |
| 3,630,000 | A | * | 12/1971 | Mullings | 96/81 |
| 3,654,747 | A | * | 4/1972 | Remick | 96/81 X |
| 3,945,813 | A | | 3/1976 | Iinoya et al. | 96/29 |
| 4,098,591 | A | | 7/1978 | van Diepenbroek et al. | 95/57 |
| 4,140,498 | A | * | 2/1979 | Krause | 96/81 |
| 4,205,969 | A | | 6/1980 | Matsumoto | 96/66 |
| 4,244,710 | A | | 1/1981 | Burger | 422/4 X |
| 4,244,712 | A | | 1/1981 | Tongret | 422/121 X |
| 4,313,740 | A | | 2/1982 | Kalishman | 55/527 X |
| 4,313,741 | A | | 2/1982 | Masuda et al. | 96/78 |
| 4,321,066 | A | | 3/1982 | Masuda | 96/40 |
| 4,341,537 | A | * | 7/1982 | Rodgers | 96/81 X |
| 4,344,776 | A | * | 8/1982 | Yavnieli | 96/63 |
| 4,405,342 | A | | 9/1983 | Bergman | 55/354 X |
| 4,541,847 | A | | 9/1985 | Oie et al. | 55/507 X |

(List continued on next page.)

FOREIGN PATENT DOCUMENTS

| | | |
|---|---|---|
| WO | WO 91/05611 | 5/1991 |

*Primary Examiner*—Richard L. Chiesa
(74) *Attorney, Agent, or Firm*—George R. McGuire; Hancock & Estabrook, LLP

(57) ABSTRACT

Disclosed is a portable air filtration system for removing contaminants from room air. In one embodiment, the air filtration system comprises a power supply and an air blower module electrically connected to the power supply. The air filtration system further comprises an ionization module engaged with the air blower module and comprising a first control grid and a high voltage grid electrically connected to the power supply. The air filtration system further comprises a filter module removably engaged with the ionization module. The filter module comprises a filter and a second control grid. Engagement of the filter module and the ionization module creates an electrical connection between the second control grid and the power supply. Activation of the air filtration system creates a first ionization field between the high voltage grid and the first control grid and a second ionization field between the high voltage grid and the second control grid.

16 Claims, 24 Drawing Sheets

U.S. PATENT DOCUMENTS

| | | | | | |
|---|---|---|---|---|---|
| 4,549,887 | A | | 10/1985 | Joannou | 55/493 X |
| 4,581,046 | A | | 4/1986 | Bergman | 55/484 X |
| 4,623,365 | A | | 11/1986 | Berman | 55/498 X |
| 4,654,054 | A | | 3/1987 | Snaddon et al. | 96/68 |
| 4,662,903 | A | | 5/1987 | Yanagawa | 96/59 |
| 4,702,752 | A | | 10/1987 | Yanagawa | 55/529 X |
| 4,715,870 | A | | 12/1987 | Masuda et al. | 96/67 |
| 4,737,169 | A | | 4/1988 | Bossard | 96/58 |
| 4,759,778 | A | | 7/1988 | Conrad | 96/59 |
| 4,938,786 | A | | 7/1990 | Tonomoto | 55/528 X |
| 4,940,470 | A | | 7/1990 | Jaisinghani | 55/521 X |
| 4,978,372 | A | | 12/1990 | Pick | 96/67 |
| 5,024,681 | A | | 6/1991 | Chang | 110/217 X |
| 5,071,455 | A | * | 12/1991 | Abedi-Asl | 96/80 |
| 5,108,470 | A | | 4/1992 | Pick | 96/58 |
| 5,290,343 | A | * | 3/1994 | Morita et al. | 96/77 X |
| 5,330,559 | A | | 7/1994 | Cheney et al. | 95/63 |
| 5,368,635 | A | | 11/1994 | Yamamoto | 96/17 |
| 5,403,383 | A | | 4/1995 | Jaisinghani | 95/69 |
| 5,454,859 | A | * | 10/1995 | Chiba et al. | 96/18 |
| 5,456,742 | A | * | 10/1995 | Glenn et al. | 96/26 |
| 5,529,613 | A | * | 6/1996 | Yavnieli | 96/63 |
| 5,540,761 | A | | 7/1996 | Yamamoto | 96/67 |
| 5,593,476 | A | | 1/1997 | Coppom | 95/78 |
| 5,647,890 | A | | 7/1997 | Yamamoto | 95/69 |
| 5,669,963 | A | * | 9/1997 | Horton et al. | 96/77 |
| 5,702,507 | A | * | 12/1997 | Wang | 96/55 |
| 5,707,429 | A | * | 1/1998 | Lewis | 96/82 X |
| 5,759,239 | A | | 6/1998 | Yu | 96/3 |
| 5,820,660 | A | * | 10/1998 | Ko | 96/81 X |
| 5,846,302 | A | * | 12/1998 | Putro | 96/80 X |
| 5,855,653 | A | | 1/1999 | Yamamoto | 96/58 |
| 5,958,112 | A | * | 9/1999 | Nojima | 96/55 |
| 6,090,184 | A | * | 7/2000 | Cartellone | 96/63 X |
| 6,183,200 | B1 | * | 2/2001 | Chang | 96/63 X |

* cited by examiner

ELECTRONICALLY ENHANCED MEDIA AIR FILTRATION SYSTEM

BACKGROUND OF THE INVENTION

1. Field of the Invention

The present invention relates generally to the field of electronic air filtration systems, and more particularly, to portable electronic air filtration systems for use in homes and offices.

2. Background

People spend a significant amount of time indoors and exposure to indoor pollutants may cause serious health problems. There are many sources of airborne pollutants or contaminants including industrial exhaust, paint and oil mist, tobacco smoke, pollens, bacteria, viruses, dust, and volatile organic compounds (VOC's).

Various air filtration systems have been developed in an attempt to remove contaminants from the air. Conventional air filtration systems are not without their drawbacks. For example, conventional air filtration systems have an air filter that cannot be easily removed and replaced by an end user. As such, an end user may be less likely to regularly change the air filter to maintain the optimal operating efficiency of the air filtration system. Second, conventional systems do not provide adequate sealing techniques to ensure that all contaminated air pass thru the ionization process and the filtering process.

OBJECTS OF THE INVENTION

One object of the present invention is to provide an air filtration system having an air filter that can be easily removed and replaced.

Another object of the invention to is to provide an air filtration system wherein all of the contaminated air is forced thru the air filter.

Another object of the present invention is to provide a one or two piece molded filter module that can be easily manufactured, removed and replaced in an air filtration system.

Another object of the present invention is to change direction of the air entering the air filtration system which reduces noise (sound) levels experienced with straight air flow systems.

Another object of the present invention is to "push" air through the motor/blower then through the filter elements, which reduces contaminates emitted from the motor as compared to conventional systems which "pull" air through the filter and then past the motor.

Other objects and advantages of the present invention will in part be obvious and in part appear hereinafter.

BRIEF SUMMARY OF THE INVENTION

The present invention is a portable air filtration system for removing contaminants from room air. In one embodiment, the air filtration system comprises an air blower module electrically connected to a power supply. The air filtration system further comprises an ionization module engaged with the air blower module and comprising a first control grid and a high voltage grid electrically connected to the power supply. The air filtration system further comprises a primary filter module removably and sealably engaged with the ionization module. The primary filter module comprises a filter membrane and a second control grid. Engagement of the primary filter module and the ionization module create an electrical connection between the second control grid and the power supply. Activation of the air filtration system creates a first ionization field between the high voltage grid and the first control grid and a second ionization field between the high voltage grid and the second control grid. In the air filtration system of the present invention, all of the contaminated air is forced through the ionization module and the primary filter module thereby providing an air filtration system having an operating efficiency significantly higher than conventional air filtration systems. Unlike conventional air filtration systems, the air filtration system of the present invention allows a user to easily remove and replace the primary filter module as desired to maintain the operating efficiency of the air filtration system.

BRIEF DESCRIPTION OF THE DRAWINGS

The following description of the invention will be better understood with reference to the accompanying drawings in which.

DESCRIPTION OF THE INVENTION

Figure 1:
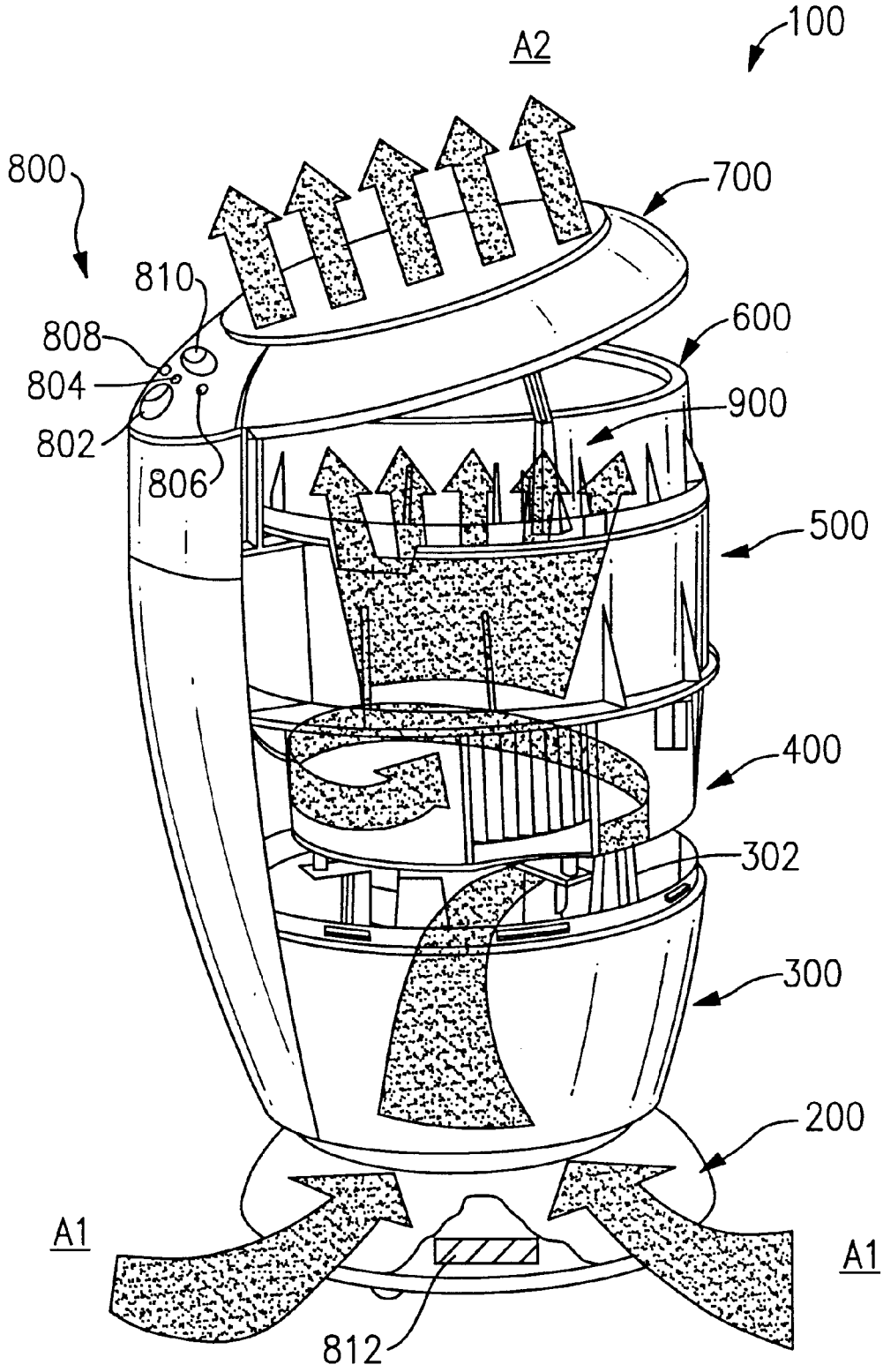
FIG. 1 is a perspective and partial cut-away view of the present invention.

Referring to FIG. 1, where a first embodiment of a portable air filtration system 100 is illustrated and generally comprises a base module 200, an air intake module 300, an air blower module 400, an ionization module 500, a primary filter module 600, and a secondary filter module 700. The air intake module 300 is generally provided to receive contaminated air A1 from the surrounding room or environment (not shown) and to direct the contaminated air A1 into the air blower module 400. The air blower module 400 is generally provided to force or push the contaminated air A1 through the ionization module 500, the primary filter module 600, and the secondary filter module 700. The ionization module 500 is sealably engaged with the air blower module 400 and is generally provided to ionize the contaminated air A1 prior to exposure to the primary filter module 600. The primary filter module 600 is removably and sealably engaged with the ionization module 500 and is generally provided to expose the contaminated air A1 to a concurrent ionization and filtering process to remove unwanted particles from the contaminated air A1. The secondary filter module 700 is generally provided to expose the air A1 leaving the primary filter module 600 to a secondary filtering process that removes volatile organic compounds (VOC's) and to return the treated air A2 to the room or environment (not shown). The air filtration system 100 further comprises a control module 800 having an on/off switch 802, an on/off indicator 804, a bio-monitor indicator 806, and a primary filter indicator 808. The on/off switch 802 is generally provided to allow the user to turn the air filtration system 100 on and off. The on/off indicator 804 is generally provided to indicate to the user whether or not the air filtration system 100 is on or off. The bio-monitor indicator 806 is generally provided to indicate to the user whether or not the ionization module 500 is working properly. Similarly, the primary filter indicator 808 is generally provided to indicate to the user whether or not the primary filter module 600 is working properly. The control module 800 further comprises a switch 810 that is generally adapted to allow the user to select a desired air flow rate of the air filtration system 100. The control module 800 further comprises a power supply 812 disposed within the base module 200 and which is generally adapted to supply power to the various components of the control module 800 and air filtration system 100. The air filtration system 100 further comprises a locking mechanism 900 which is generally adapted to allow the user to securely engage the primary filter module 600 with the ionization module 500 and to allow replacement of the primary filter module 600 when the primary filter indicator 808 indicates that the primary filter module 600 is full of contaminants and needs replacement.

Figure 2:
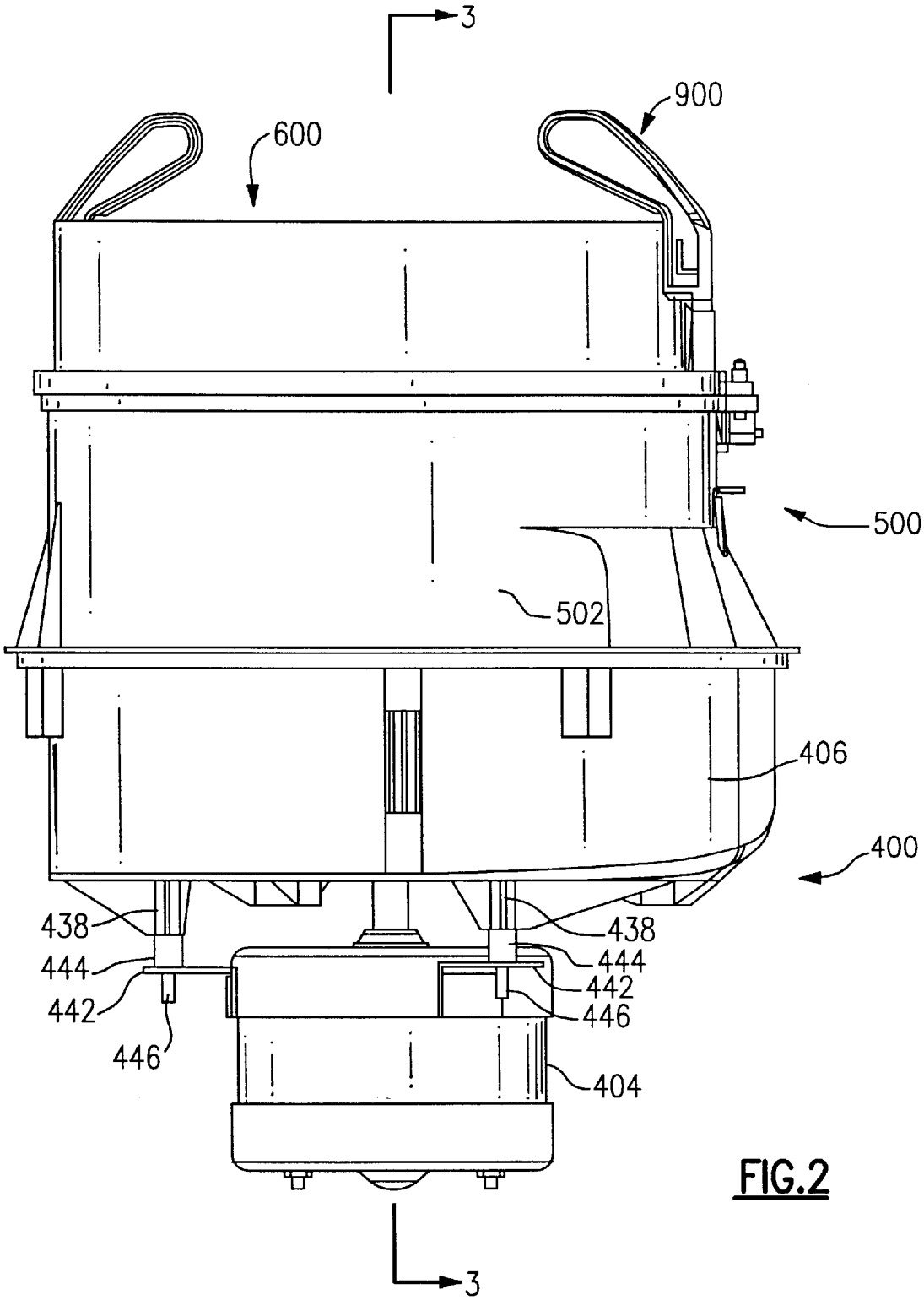
FIG. 2 is a plan view of an assembled air blower module, ionization module, and the primary filter module of the present invention.
Figure 3:
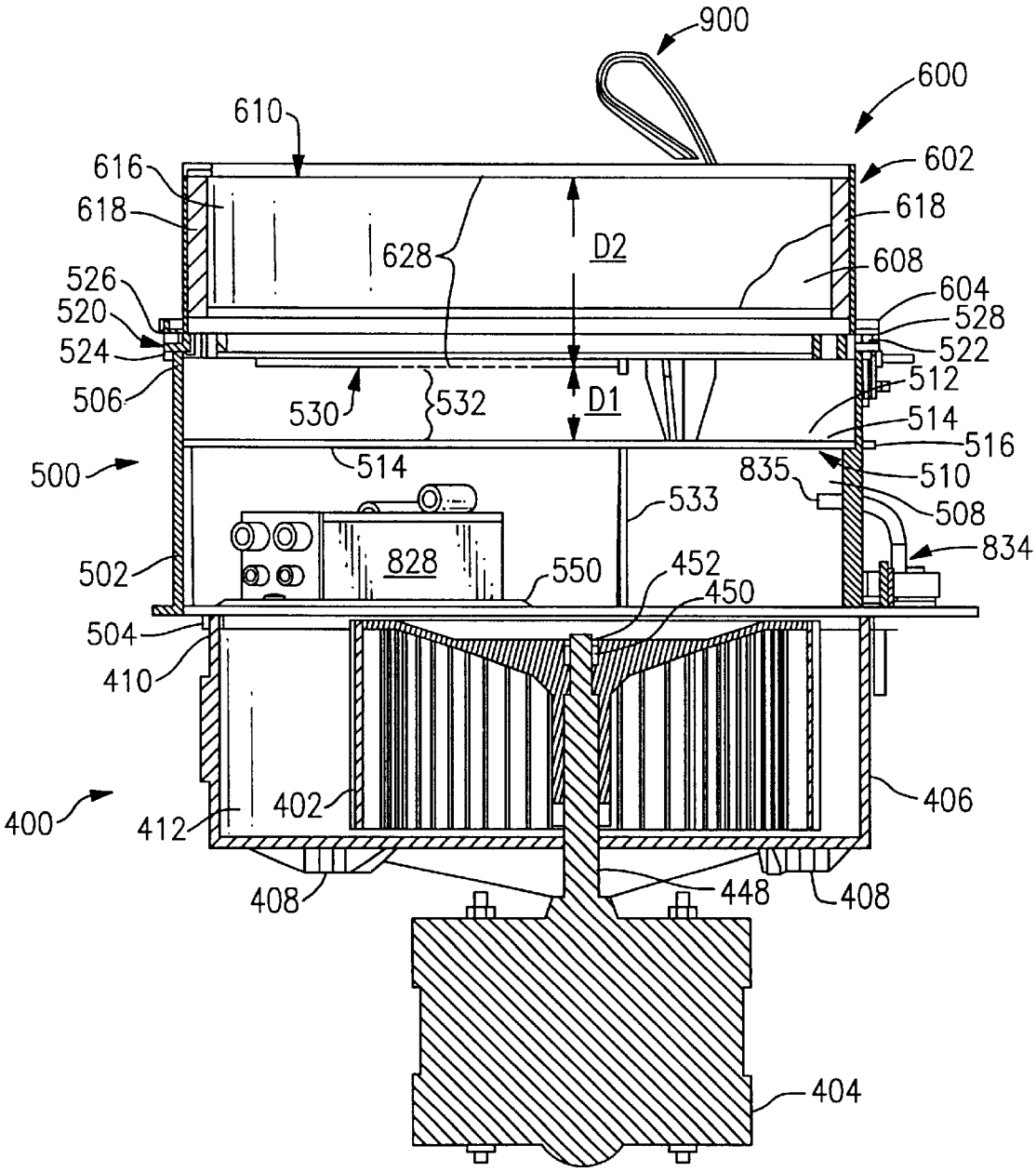
FIG. 3 is a cross section view taken along line 3—3 of FIG. 2.
Figure 4:
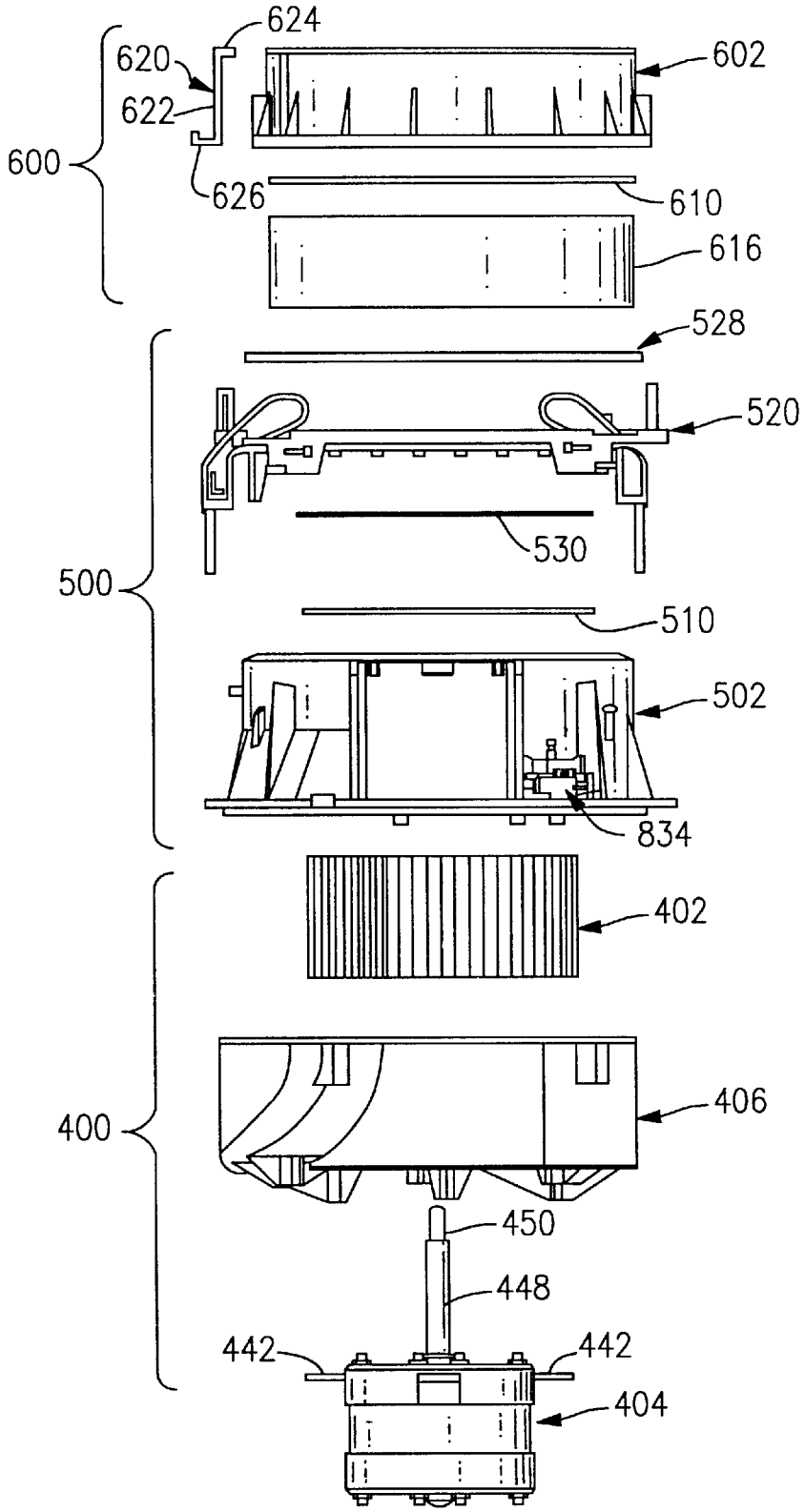
FIG. 4 is an exploded view of FIG. 2 showing the air blower module, ionization module and the primary filter module of the present invention.

Referring to FIGS. 2–4, wherein the air blower module 400, the ionization module 500 and the primary filter module 600 are shown in greater detail. The air blower module 400 comprises a fan 402 and a motor 404 electrically connected to the power supply 812. The air blower module 400 further comprises a housing 406 having a lower engagement portion 408 and an upper engagement portion 410. The lower engagement portion 408 engages with an upper engagement portion 302 (FIG. 1) of the air intake module 300. The air blower module 400 further comprises a cavity portion 412. The fan 402 is disposed within the cavity portion 412 and the motor 404 is disposed outside of and below the cavity portion 412. The motor 404 comprises a plurality of mounting flanges 442 and isolators 444 which engage with corresponding mounting bosses 438 and threaded holes 440 in the housing 406 by conventional means such as a screw 446. The motor 404 comprises an output shaft 448 having a threaded end portion 450 that is engaged with the fan 402 by conventional fastening means such as a nut 452. The relative positioning of the motor 404 below the fan 402 results in the contaminated air to being "pushed" rather than "pulled" thru the ionization module 500 and the primary filter module 600, thereby increasing the overall particle removal efficiency of the air filtration system 100 in that the particles inherent and/or discharged by operation of the fan 402 and motor 404 enter the existing contaminated air prior to filtration by the ionization module 500 and the primary filter module 600. In the embodiment shown, the fan 402 is an impeller fan and the motor 404 is an induction or shaded pole motor.

The ionization module 500 further comprises a lower housing 502 having a lower engagement portion 504, an upper engagement portion 506, and a cavity portion 508. The lower engagement portion 504 is sealably engaged with the upper engagement portion 410 of the air blower module 400. The ionization module 500 further comprises a first or lower control grid 510 connected to the power supply 812 and disposed within the cavity portion 508. The first control grid 510 comprises a conductive plate 512 having a plurality of openings 514 and a contact terminal 516 extending outward from the conductive plate 512 and housing 502 for connection to the power supply 812. The ionization module 500 further comprises an upper or high voltage housing assembly 520 comprising a housing 522, a lower engagement portion 524 and an upper engagement portion 526. The lower engagement portion 524 is sealably connected to the upper engagement portion 506 of the lower housing 502. The upper engagement portion 526 comprises a sealing member 528 to sealably engage with the lower engagement portion 604 (to be described) of the primary filter module 600. The high voltage housing assembly 520 further comprises a high voltage grid 530 electrically connected to the power supply 812. The ionization module 500 further comprises a plurality of support members 533 adapted to support the first control grid 510 at a distance D1 below the high voltage grid 530. In order to have a particle efficiency rating equivalent to a HEPA grade filter, distance D1 must be between 1.10 inches and 1.62 inches. Activation of the air filtration system 100 causes a first or lower ionization field 532 to be generated between the high voltage grid 530 and the lower control grid 510. The high voltage grid 530 is designed to operate at a power density of between 0.027 and 0.043 watts per square inch.

The primary filter module 600 further comprises a housing 602 having a lower engagement portion 604. The lower engagement portion 604 is sealably engageable with the upper engagement portion 526 of the ionization module 500. The primary filter module 600 further comprises a second or upper control grid 610. The primary filter module 600 further comprises a cavity portion 608 having a pleated filter membrane 616 encapsulated and hermetically sealed by a sealing member 618 within the cavity portion 608 to force all of the contaminated air entering the primary filter module 600 to pass thru the pleated filter membrane 616. Activation of the air filtration system 100 causes a second or upper ionization field 628 to be generated between the high voltage grid 530 and the upper control grid 610. Upon engagement of the primary filter module 600 and the ionization module 500, the upper control grid 610 is disposed a distance D2 above the high voltage grid 530. In order to avoid arcing between the high voltage grid 530 and the upper control grid 610, distance D2 is designed to be greater than distance D1. As such, any arcing from the high voltage grid 530 will be to the lower control grid 510 thereby reducing the risk of damage to the air filter module 600 and therefore premature replacement.

Figure 5:
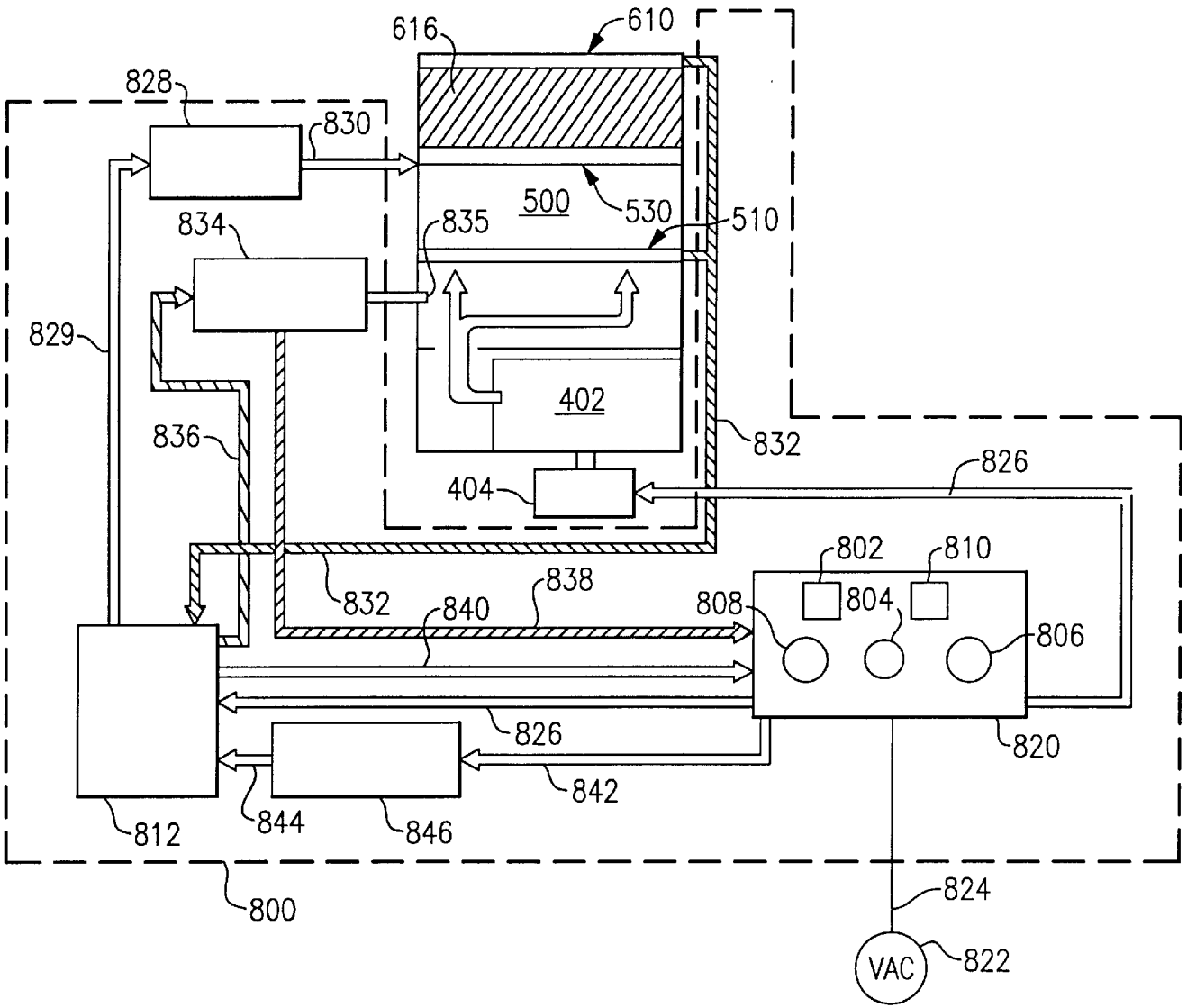
FIG. 5 is a high level block diagram showing the electronic circuitry of the control module 800 and operation of the present invention.
Figure 6:
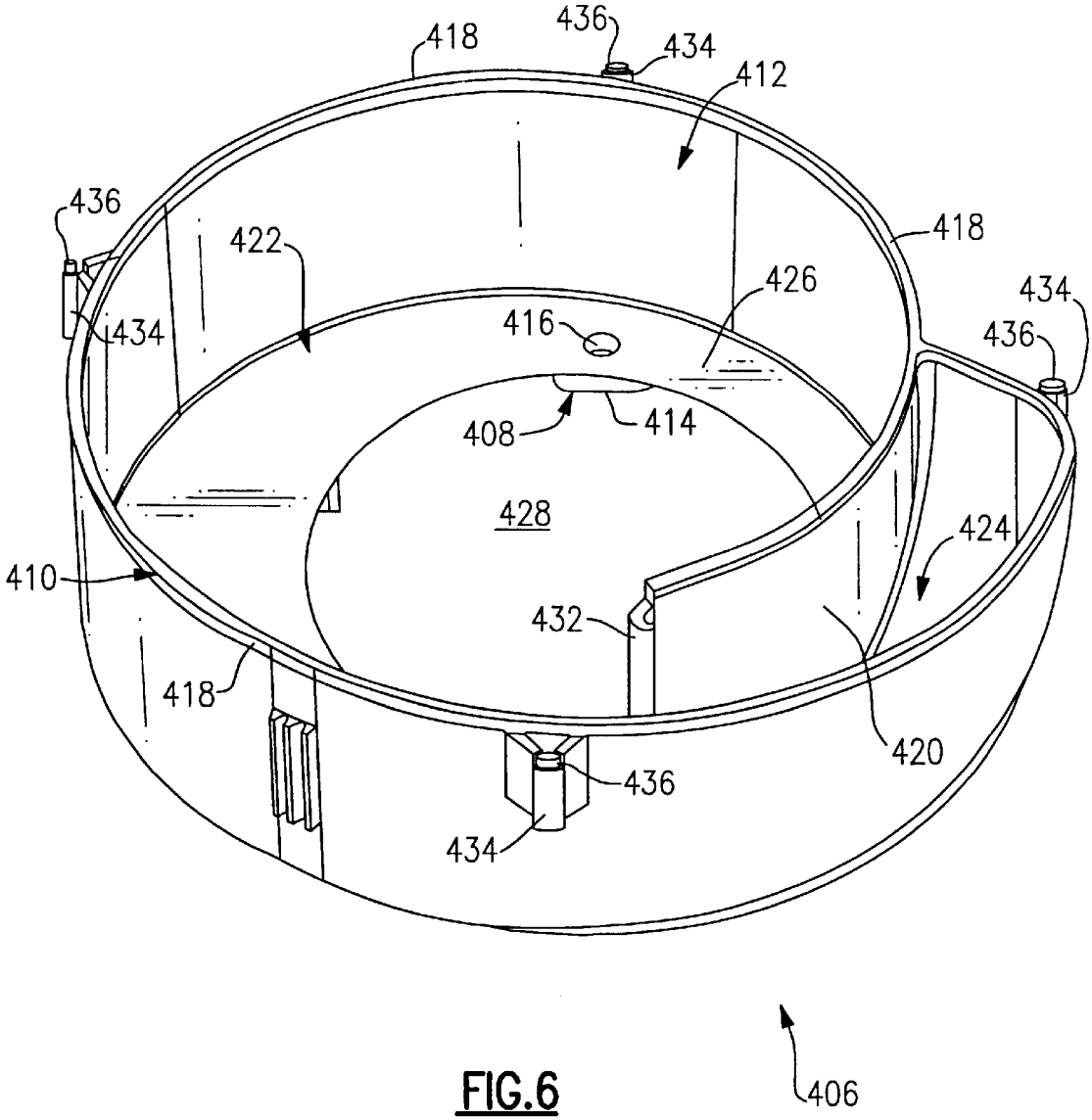
FIG. 6 is a perspective view of the air blower housing.
Figure 7:
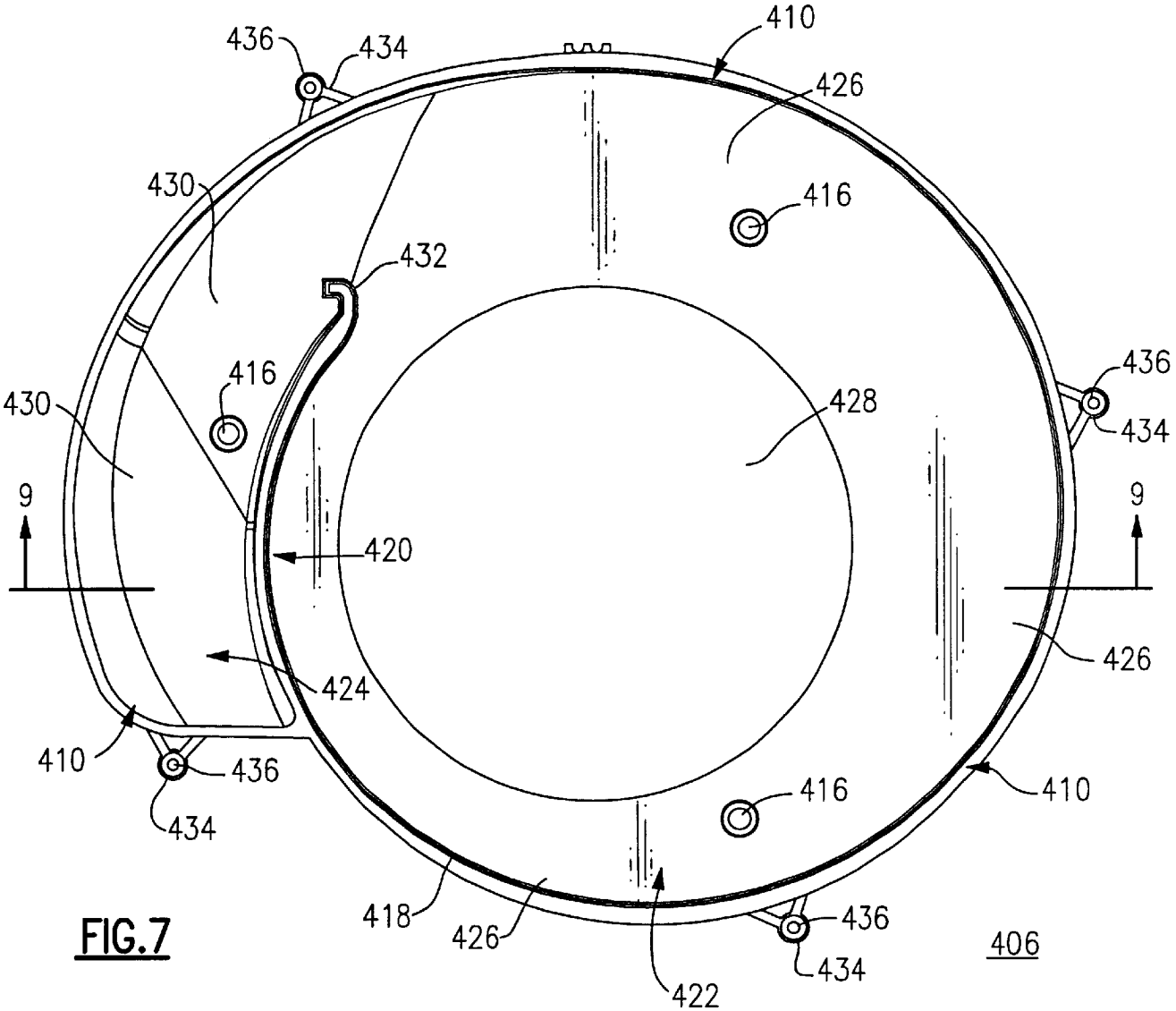
FIG. 7 is a top plan view of the air blower housing.
Figure 8:
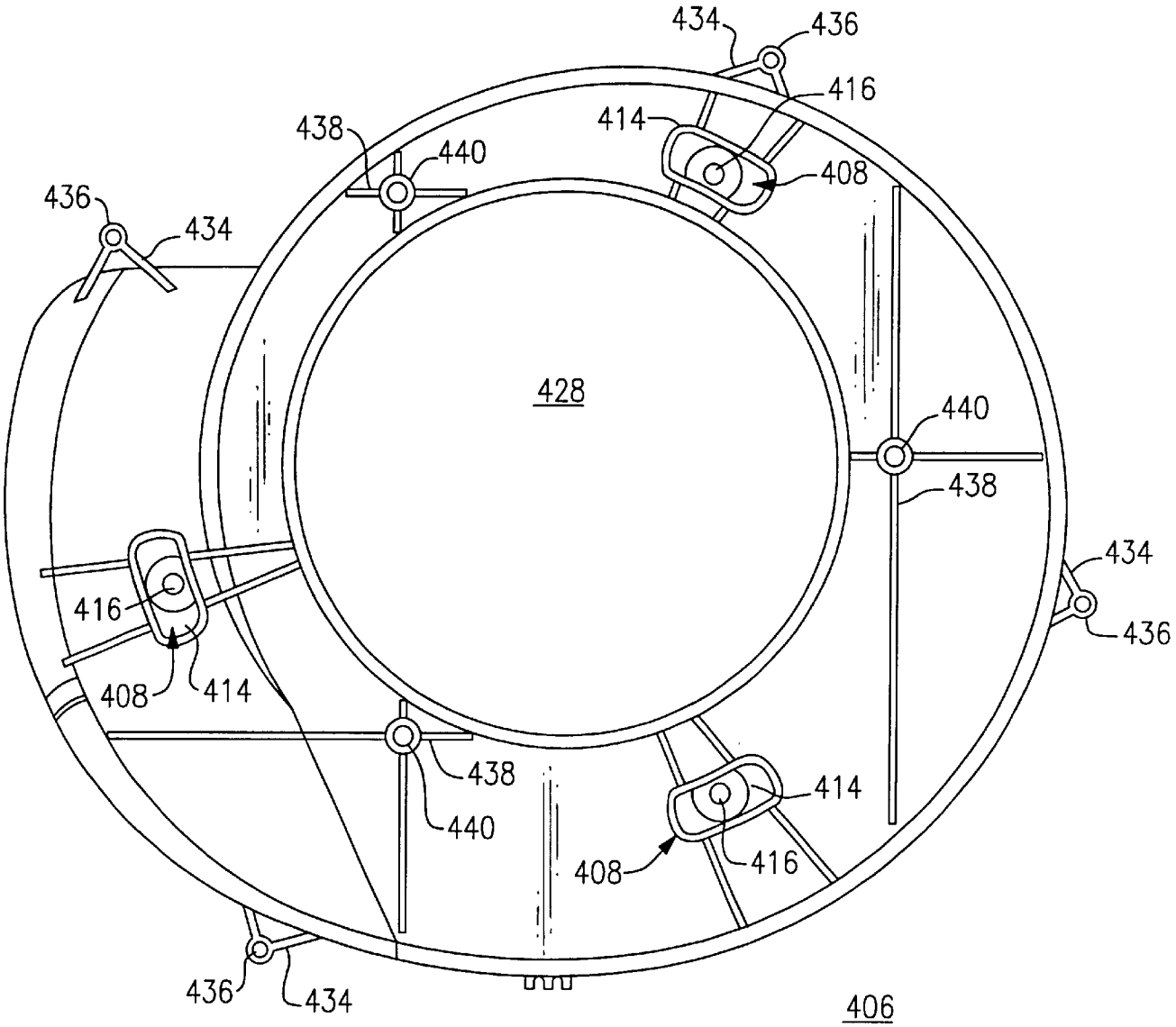
FIG. 8 is a bottom plan view of the air blower housing.
Figure 9:
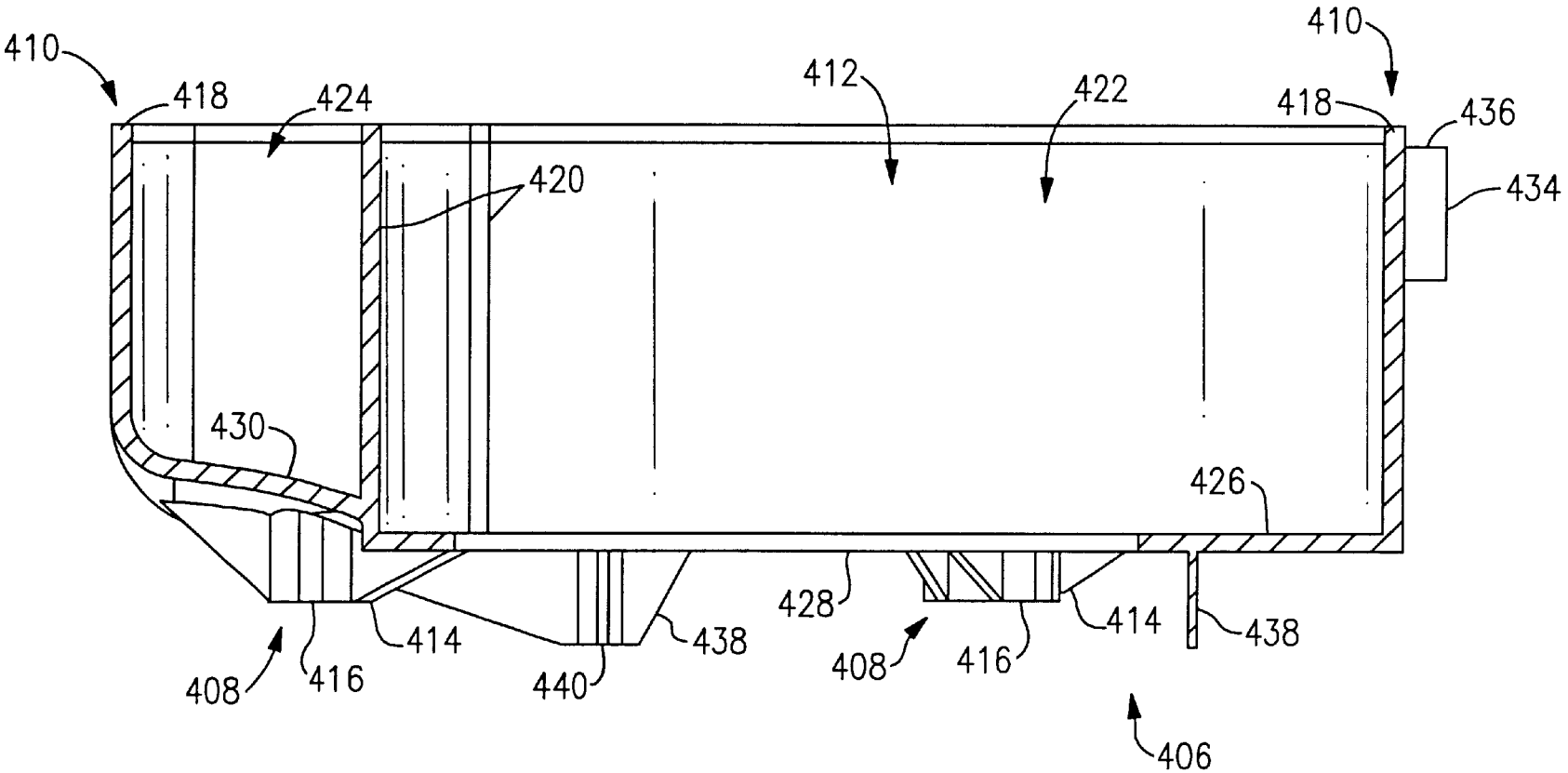
FIG. 9 is a cross section view of the air blower housing taken along line 9—9 of FIG. 7.

Referring to FIG. 5, wherein a high level block diagram shows the electrical circuitry of the control module 800 and general operation of the air filtration system 100. The control module 800 generally comprises a circuit board 820 having connected thereto the on/of switch 802, on/off indicator 804, biomonitor indicator 806, primary filter indicator 808, and fan speed switch 810. An external power source 822 is electrically connected through the on/off switch 802 along a path 824 to form a low voltage power circuit 826 upon activation of the on/off switch 802 to the "on" position. The motor 404 and the power supply 812 are each electrically connected to the low voltage power circuit 826. Activation of the on/off switch 802 to the "on" position causes the on/off indicator 804 to illuminate thereby indicating to the user that air filtration system 100 is "on." The control module 800 further comprises a voltage multiplier 828 having an input electrically connected to the power supply 812 along a path 829 and an output electrically connected to the high voltage grid 530 of the ionization module 500 along a high voltage path 830. The voltage multiplier 828 increases or steps up the voltage from the output of power supply 812 to about 16,000 volts. The control grids 510 and 610 are connected to cell return of the power supply 812 along a path 832. The control module 800 further comprises a pressure transducer 834 mounted on the ionization module 500 and adapted to detect the pressure within the ionization module 500. The pressure transducer 834 is electrically connected to the power supply 812 along a path 836 and to the circuit board 820 and primary filter indicator 808 along a path 838. If the pressure within the ionization module 500 stays within a defined limit, the primary filter indicator 808 will remain illuminated indicating to the user that the primary filter module 600 is operating normally. If the pressure within the ionization module 500 falls outside the defined limits, the primary filter indicator 808 will not illuminate indicating to the user that the primary filter module 600 is not operating normally and needs to be replaced. The high voltage path 830 and the return path 832 are connected through at the high voltage power supply 812. The step down transformer 846 supplies low voltage signal power to the power supply 812 along paths 842 and 844. The biomonitor indicator 806 is connected from the power supply 812 to control board 820 along path 840. If a short or open connection exists in the high voltage path 830 or return path 832, the biomonitor indicator 806 will not illuminate indicating to the user that the ionization module 500 is not working properly. The high voltage power supply is comprised of two stages. Stage ones input is 120 AC voltage and is increased approximately twenty seven times though a step up transformer. This output is fed to the second stage, which multiplies this output five times to meet the voltage and current requirement of the system.

Stage one of the power supply incorporates a voltage limiting regulation circuit. Should stage one of the power supply see an open circuit condition the regulation circuit will prevent the output voltage to rise above a preset value. Should stage one of the power supply see a short condition on its output this same regulation circuit will shut down the power supply until the short is removed. (Full recovery of the power supply).

As a positive feedback that the power supply is functioning within the defined limits of the system a load sensing circuit is built into stage one. This circuit is monitoring the return current from the load to ground. When the return current is within defined limits this circuit outputs a low-level voltage signal to the display board and illuminates an enunciator indicating that the high voltage circuit is functional. When the load current fall outside the defined limits of the system this circuit extinguishes the enunciator indicating that there is an interruption in the high voltage circuit.

Referring to FIGS. 6–9, wherein the housing 406 of the air blower module 400 generally comprises the lower engagement portion 408, the upper engagement portion 410, and the cavity portion 412 as heretofore described. In the embodiment shown, the lower engagement portion 408 comprises a plurality of outward extending mounting recesses 414 which are adapted to engage with and receive the corresponding upper engagement portions 302 (FIG. 1) of the air intake module 300. Each of the recesses 414 has an opening or thru hole 416 which allows each of the mounting recesses 414 to be secured to the corresponding upper engagement portions 302 by conventional fastener means such as a screw (not shown). In the embodiment shown, the upper engagement portion 410 comprises a tapered wall portion 418 that extends around the entire circumference of the cavity portion 412 and engages with a corresponding tapered recessed portion 534 (to be described) of the ionization module 500 to provide sealed engagement between the ionization module 500 and the air blower module 400. The tapered wall portion 418 of the upper engagement portion 410 and the tapered recessed portion 534 of the lower engagement portion 504 of the ionization module 500 form a mechanical sealing joint which is commonly known as a morse or locking taper. The housing 406 further comprises a plurality of spaced mounting bosses 434 each having a threaded hole 436 that are adapted to engage with corresponding thru-holes 568 (to be described) of the lower housing 502 to securely engage the ionization module 500 to the air blower module 400. The cavity portion 412 comprises a partition wall 420 to form an air intake portion 422 and an air exhaust portion 424. The air intake portion 422 comprises a generally planar floor portion 426 having an opening 428 to receive air from the air intake module 300. The air exhaust portion 424 comprises an upward sloping floor or chute 430 that is in communication with and directs the contaminated air into the opening 540 of the cavity portion 508 of the ionization module 500. The partition wall 420 comprises a baffle portion 432 to isolate the air intake portion 422 from the air exhaust portion 424. The housing 406 is made from a high strength polymer material and manufactured by conventional injection molding processes.

Figure 10:
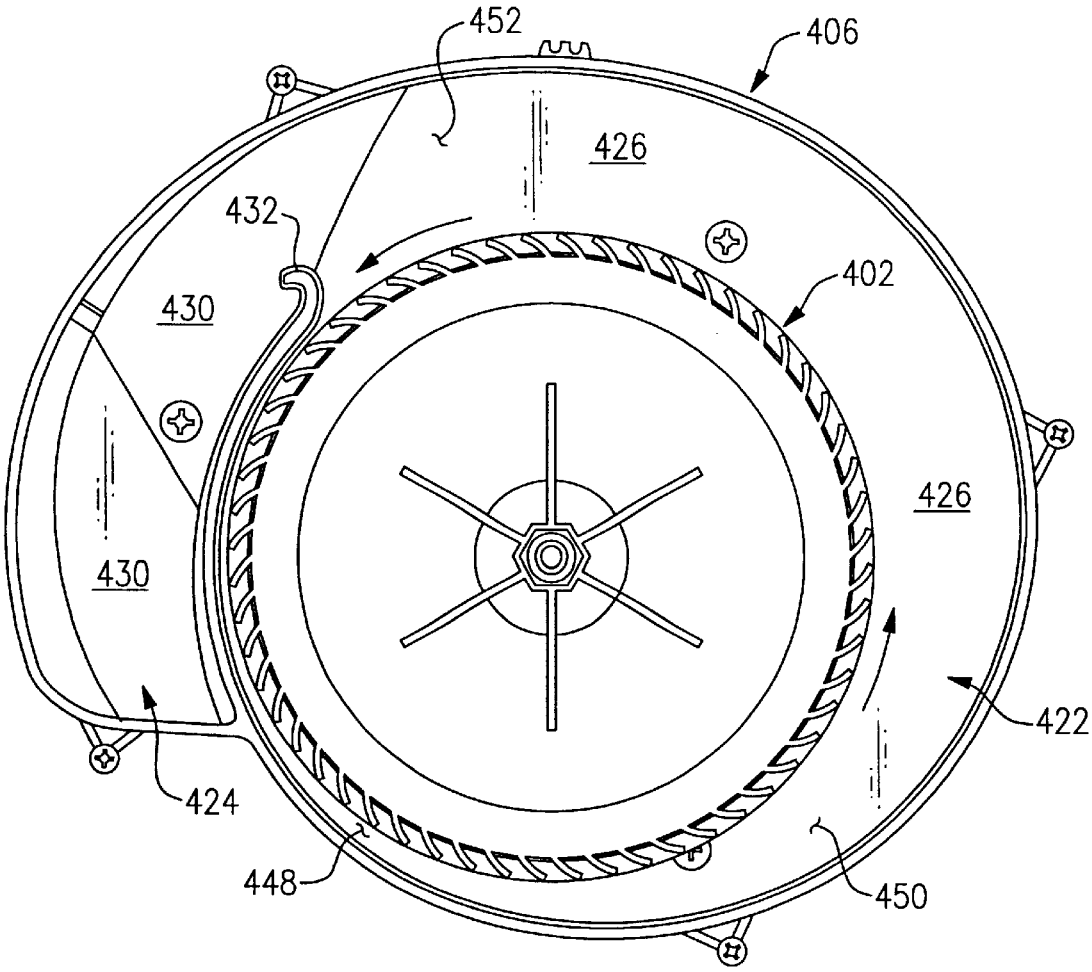
FIG. 10 is a top plan view of the fan mounted within the air blower housing.
Figure 11:
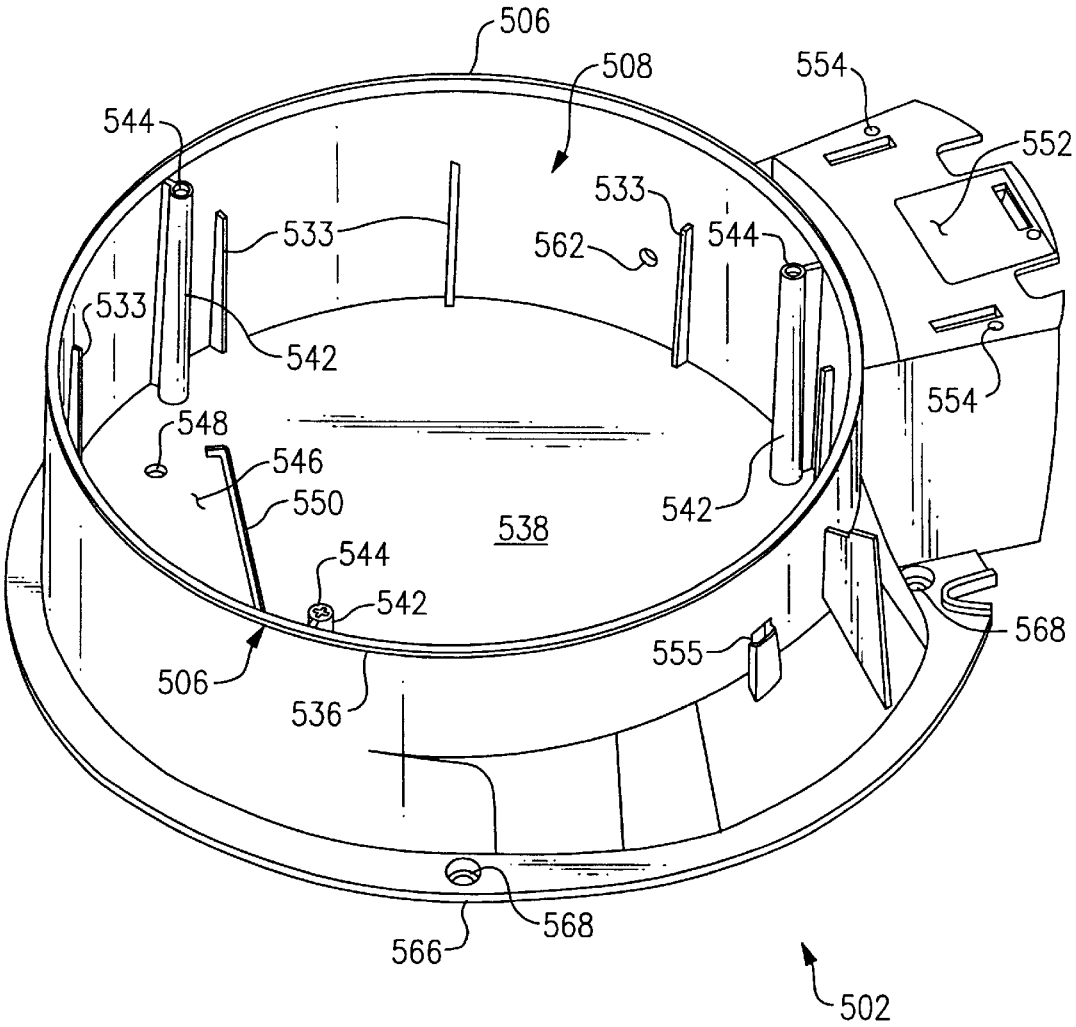
FIG. 11 is a perspective view of the lower housing of the ionization module.
Figure 12:
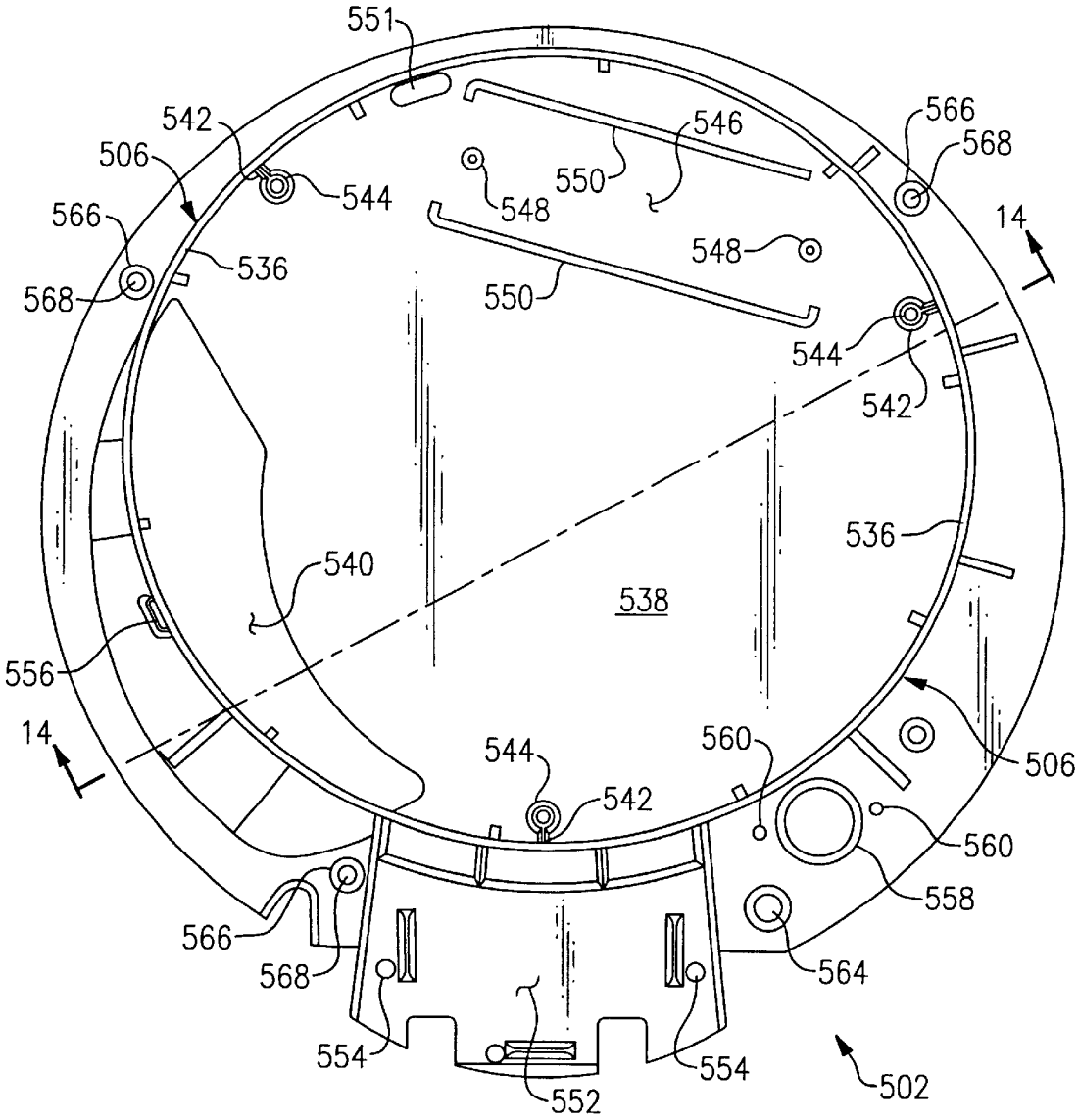
FIG. 12 is a top plan view of the lower housing of the ionization module.
Figure 13:
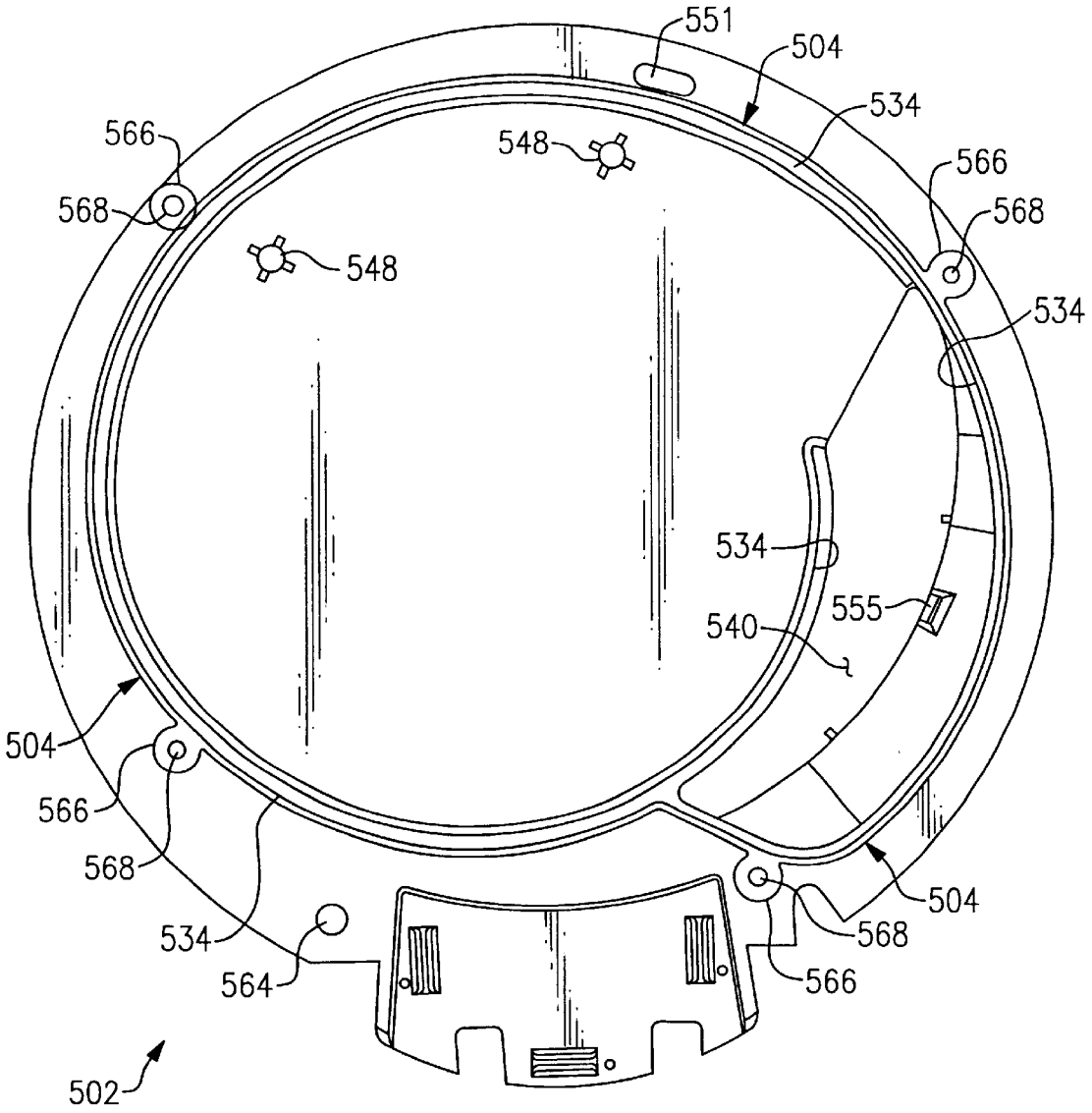
FIG. 13 is a bottom plan view of the lower housing of the ionization module.
Figure 14:
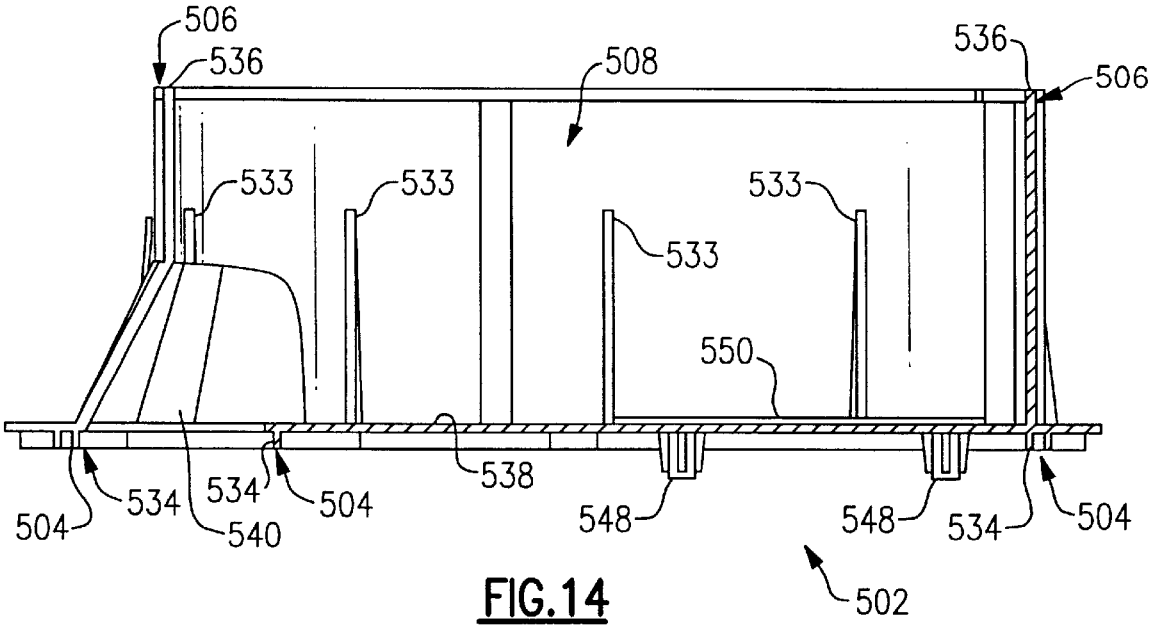
FIG. 14 is a cross section view of the air blower housing taken along line 14—14 of FIG. 12.

Referring to FIG. 10, wherein the fan 402 is shown mounted within the cavity portion 412 of the housing 406.

The fan 402 is offset from the centerline of the air inlet portion 422 such that rotation of the fan 402 within the cavity portion 412 causes a high pressure region 448 of air flow to be created which expands to low pressure regions 450 and 452 as the flow of air expands toward the air exhaust portion 424. The baffle portion 432 isolates the high pressure region 448 from the low pressure regions 450 and 452 to avoid noise and/or whistling which might otherwise be created due to "choking" of the air as it flows toward the air exhaust portion 424.

Referring to FIGS. 11–14, wherein the lower housing 502 of the ionization module 500 is shown generally comprising the lower engagement portion 504, the upper engagement portion 506, and the cavity portion 508 as heretofore described. In the embodiment shown, the lower engagement portion 504 comprises a continuous annular tapered recess portion 534 that engages with the tapered wall portion 418 of the air blower module 400 to provide sealed engagement between the ionization module 500 and the air blower module 400. The tapered recessed portion 534 of the lower engagement portion 504 and the tapered wall portion 418 of the upper engagement portion 410 of the air blower 400 form a mechanical sealing joint which is commonly known as a morse taper. Similarly, in the embodiment shown, the upper engagement portion 506 comprises a tapered wall portion 536 that extends around the entire circumference of the cavity portion 508 and engages with a corresponding tapered recessed portion 570 (to be described) of the high voltage housing assembly 520 to provide sealed engagement between the lower housing 502 and the high voltage housing assembly 520. The tapered wall portion 536 of the upper engagement portion 506 and the tapered recessed portion 570 (to be described) form a mechanical sealing joint which is commonly known as a morse taper. The cavity portion 508 comprises a floor 538 and an opening 540. The opening 540 is in communication with the air exhaust portion 424 of the air blower module 400 to allow contaminated air to flow into the ionization module 500. The cavity portion 508 further comprises a plurality of spaced mounting bosses 542 each having a threaded hole 544 that are adapted to engage with corresponding recessed thru-holes 571 (to be described) of the lower engagement portion 524 of the upper housing 522 to securely engage the high voltage housing assembly 520 to the lower housing 502 by conventional fastening means such as a screw (not shown).

The lower housing 502 further comprises a voltage multiplier mounting portion 546 adapted to mount the voltage multiplier 828. The voltage multiplier mounting portion 546 comprises a plurality of threaded holes 548 adapted to securely engage the voltage multiplier 828 by conventional fastening means such as a screw (not shown). The voltage multiplier mounting portion 546 further comprises a flange portion 550 adapted to align the voltage multiplier 828 for mounting with threaded holes 548. The lower housing 502 further comprises an opening or passage 551 adapted to allow cables (not shown) to pass there through for connecting the voltage multiplier 828 to the power supply 812. The lower housing 502 further comprises a control module mounting portion 552 adapted to engage and mount the control module 800. The control module mounting portion 552 comprises a plurality of holes 554 adapted to securely mount the circuit board 820 of the control module 800 by conventional fastening means such as a screw (not shown). The lower housing 502 further comprises a lower control grid recess portion 556 adapted to receive the contact terminal 516 of the conductive plate 512 and to allow a connector (not shown) to mount thereon for connection to the power supply 812. The lower housing 502 further comprises a pressure transducer mounting portion 558 adapted to receive the pressure transducer 834. The pressure transducer mounting portion 558 comprises a plurality of pins 560 adapted to secure the pressure transducer 834 to the mounting portion 558 by conventional fastening means such as a push nuts (not shown). The lower housing 502 further comprises an opening 562 adapted to allow the venturi tube 835 of the pressure transducer 834 to extend within the cavity portion 508 to sense the pressure therein. The lower housing 502 further comprises a wire opening 564 adapted to allow passage of a cable (not shown) for connecting the pressure transducer 834 to the power supply 812 and to the circuit board 820. The lower housing 502 further comprises a plurality of mounting bosses 566 having recessed thru holes 568 adapted to allow a conventional fastener (not shown) to be inserted therein and securely engaged with the holes 436 of the air blower module 400.

Referring to FIGS. 15–19, wherein the high voltage housing assembly 520 is shown comprising the housing 522, the lower engagement portion 524, the upper engagement portion 526, the sealing member 528, and the high voltage grid 530 as heretofore described. In the embodiment shown, the lower engagement portion 524 comprises a tapered recessed portion 570 that extends around the entire circumference of the bottom of the housing 522 and is adapted to receive and engage with the tapered wall portion 536 to provide sealed engagement between the lower housing 502 and the high voltage housing assembly 520. The tapered wall portion 536 of the lower housing 502 and the tapered recessed portion 570 of the housing 522 form a mechanical sealing joint which is commonly known as a morse taper. The housing 522 further comprises a plurality of recessed mounting holes 571 spaced for alignment with the threaded holes 544 of the mounting boss 542 of the lower housing 502 to allow the high voltage housing assembly 520 to be securely engaged to the lower housing 502 by conventional fastening means such a screw (not shown). The housing 522 further comprises a plurality of control grid retention members 572 engaged with and extending downward from the bottom of the housing 522. The retention members 572 are adapted and sized to be in contact with the first control grid 510 when the high voltage housing assembly 520 is mounted to the lower housing 502 to thereby retain the first control grid 510 within the cavity 508 of the lower housing 502. The housing 522 may further comprise a plurality of flanges 573 extending downward from the housing 522. The flanges 573 are provided for alignment of the lower engagement portion 524 with the upper engagement portion 506 of the lower housing 502. The housing 522 further comprises an open frame portion 574 having a plurality of cross members 575 adapted to provide structural support for the housing 522 to provide for ion wire protection and to allow unrestricted flow of air from the ionization module 500 to the primary filter module 600. In the embodiment shown, the cross members 575 are formed as part of the housing 522. The housing 522 further comprises a plurality of wire retention members 576 extending downward from and spaced annularly around the bottom of the housing 522. The wire retention members 576 are adapted to retain a wire 587 (to be described) of the high voltage grid 530. In the embodiment shown, the wire retention members 576 are formed as part of the housing 522. The housing 522 further comprises a spring mounting member 577 extending downward from the bottom of the housing 522. The spring mounting member 577 is adapted to provide a mounting portion for a spring 590 (to be described) of the high voltage grid 530. In the embodiment shown, the spring mounting member 577 is formed as part of the housing 522. The housing 522 further comprises a first contact terminal mounting boss or portion 578. The mounting boss 578 is adapted to retain a high voltage contact terminal 582 (to be described). In the embodiment shown, the mounting boss 578 is formed as part of the housing 522. The housing 522 further comprises a second contact terminal mounting boss or portion 579. The mounting boss 579 is adapted to retain a ground contact terminal 583 (to be described). In the embodiment shown, the mounting boss 579 is formed as part of the housing 522. The housing 522 further comprises a locking mechanism mounting portion 580 having a cavity portion 581 extending upward from the top of the housing 522 and adapted to receive a lever member 902 (to be described) of the locking mechanism 900. The high voltage housing assembly 520 further comprises a high voltage contact terminal 582 mounted to the mounting boss 578. The high voltage contact terminal 582 is connected to the high voltage grid 530 by the wire 587 and to the power supply 812 by a cable (not shown). The high voltage housing assembly 520 further comprises a ground contact terminal 583 mounted to the mounting boss 579. The ground contact terminal 583 has a first end portion 584 connectable to the second or upper control grid 610 of the primary filter module 600 by a bus member 620 (to be described) and a second end portion 585 connected to the return ground of the power supply 812 by a cable (not shown). The high voltage grid 530 comprises a conductive wire 587 and a spring 590. The wire 587 has a first end portion 588 and a second end portion 589. The spring 590 comprises a first end portion 591 and a second end portion 592. The first end portion 591 of the spring 590 is connected to the mounting member 577. The first end portion 588 of the wire 587 is connected to the high voltage contact terminal 582 by conventional means while the second end portion 589 of the wire 587 is connected to the second end portion 592 of the spring 590. The wire 587 is of sufficient length is wrapped around the retention members 576 and back and forth across the open frame portion 574 in a serpentine pattern. In the embodiment shown, the high voltage grid 530 is operating at a voltage of 16,000 volts and can be adjusted to operate between 15,000 and 18,000 volts. In order to prevent arcing from one row of wire 587 to an adjacent row of wire 587 under circumstances such as moist air, the spacing between each row of wire 587 should not be less than one inch which is based upon the dielectric constant of free air. The spring 590 functions to retain the wire 587 in tension around the retention members 576. The upper engagement portion 526 comprises a channel portion 593 extending around the circumference of the upper engagement portion 526. The sealing member 528 is disposed in the channel portion 593 and provides sealed engagement between the upper engagement portion 526 and the lower engagement portion 604 of the primary filter module 600. In the embodiment shown, the sealing member 528 is an o-ring 586 having a durometer of about 20 to 40. However, the sealing member 528 may take the form of any sealant or sealing ring which allows the primary filter module 600 to be sealably engaged to and disengaged from the ionization module 500.

Referring to FIGS. 20–25, wherein the primary filter module 600 generally comprises the housing 602, the lower engagement portion 604, the second or upper control grid 610, and the filter membrane 616 as heretofore described. The housing 602 is formed with a cavity portion 608 within which the upper control grid 610 and filter membrane 616 are disposed. The lower engagement portion 604 is formed as part of the housing 602 and comprises a substantially planar surface 630 that extends around the circumference of the cavity portion 608. The planar surface 630 is engageable with the upper engagement portion 526 of the ionization module 500 to provide a removable and sealed engagement between the ionization module 500 and primary filter module 600. The second or upper control grid 610 is disposed within the cavity portion 608 at an upper portion 606 of the housing 602. The upper control grid 610 comprises a conductive plate 612 having a plurality of openings 614 to allow the treated air to pass there through. The primary filter module 600 further comprises a sealing member 618 disposed between the filter membrane 616 and the cavity portion 608 and acts as a media seal to provide a hermetic seal between the filter membrane 616 and the cavity portion 608 so that all of the air passing into the primary filter module 600 is forced through the filter membrane 616. The sealing member 618 also acts to impregnate and secure the conductive plate 612 and the filter membrane 616 within the cavity portion 608. The primary filter module 600 further comprises a bus member 620 connecting the control grid 610 to the power supply 812 upon engagement of the primary filter module 600 and the ionization module 500. In the embodiment shown, the bus member 620 is a conductive strip 622 having a first end portion 624 and a second end portion 626. The housing 602 further comprises a flange portion 632 having an opening or thru hole 634. The housing 602 further comprises a recessed portion 636 adapted to receive the bus member 620. The recessed portion 636 extends from the upper portion 606 to the flange portion 632. The first end portion is connected to the control grid 610 and the second end portion 626 is disposed at the lower engagement portion 604 above the opening 634. Upon engagement of the air filter module 600 and the ionization module 500, the ground contact terminal 583 is caused to extend into the opening 634 and be electrically connected to the second end portion 626 of the conductive strip 622 to thereby create the second ionization field 628 between the high voltage grid 530 and the second control grid 610.

Figure 15:
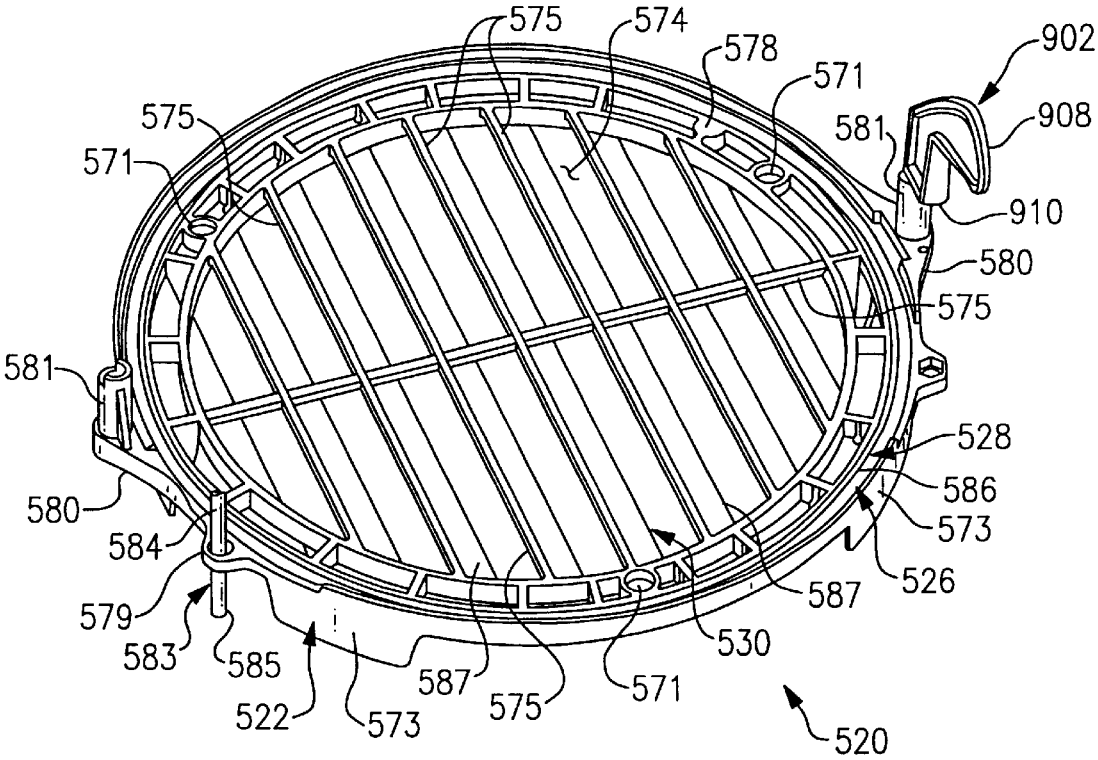
FIG. 15 is an isometric view of the high voltage housing assembly of the ionization module viewed from above the housing.
Figure 16:
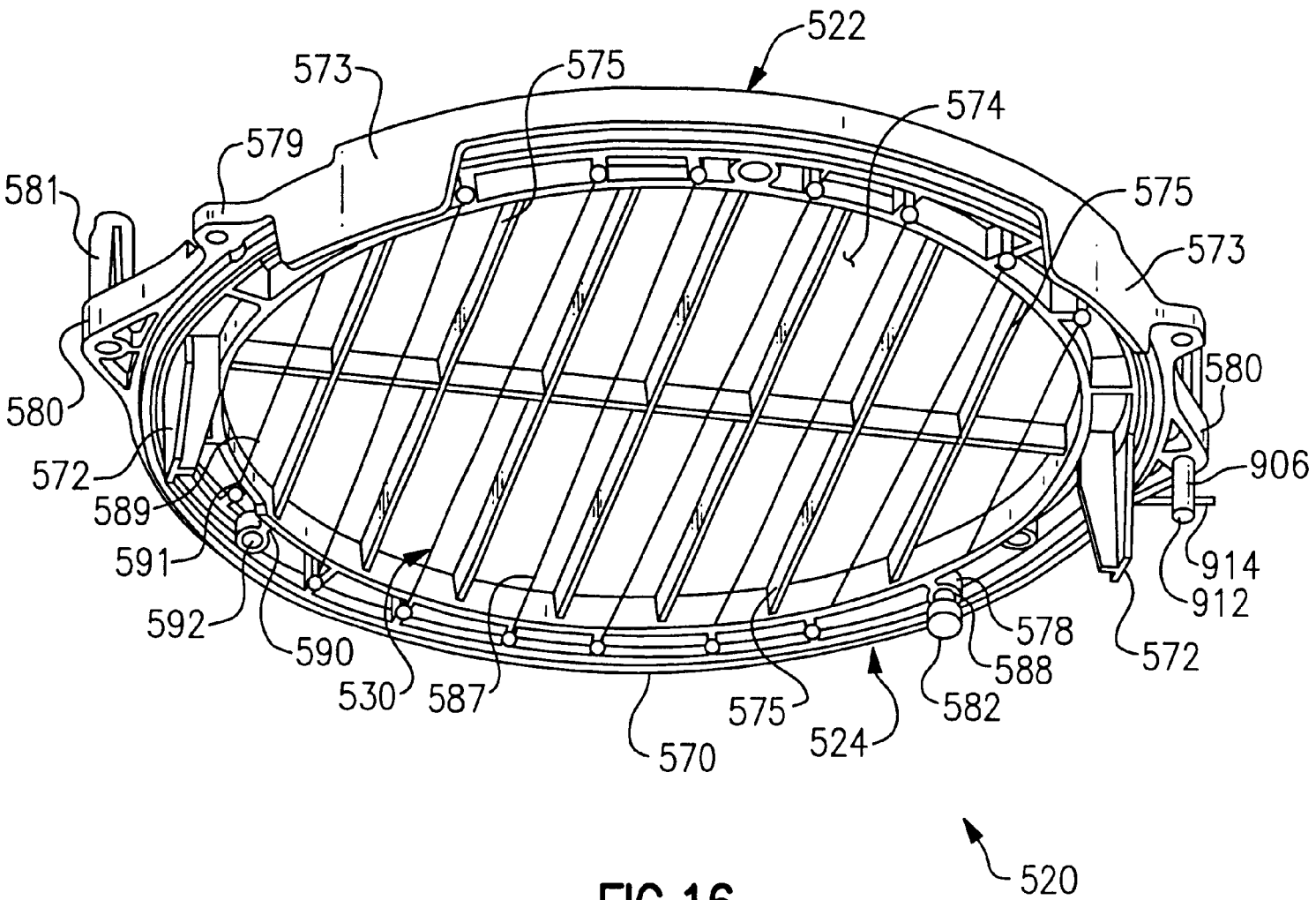
FIG. 16 is an isometric view of the high voltage housing assembly of the ionization module viewed from below the housing.
Figure 17:
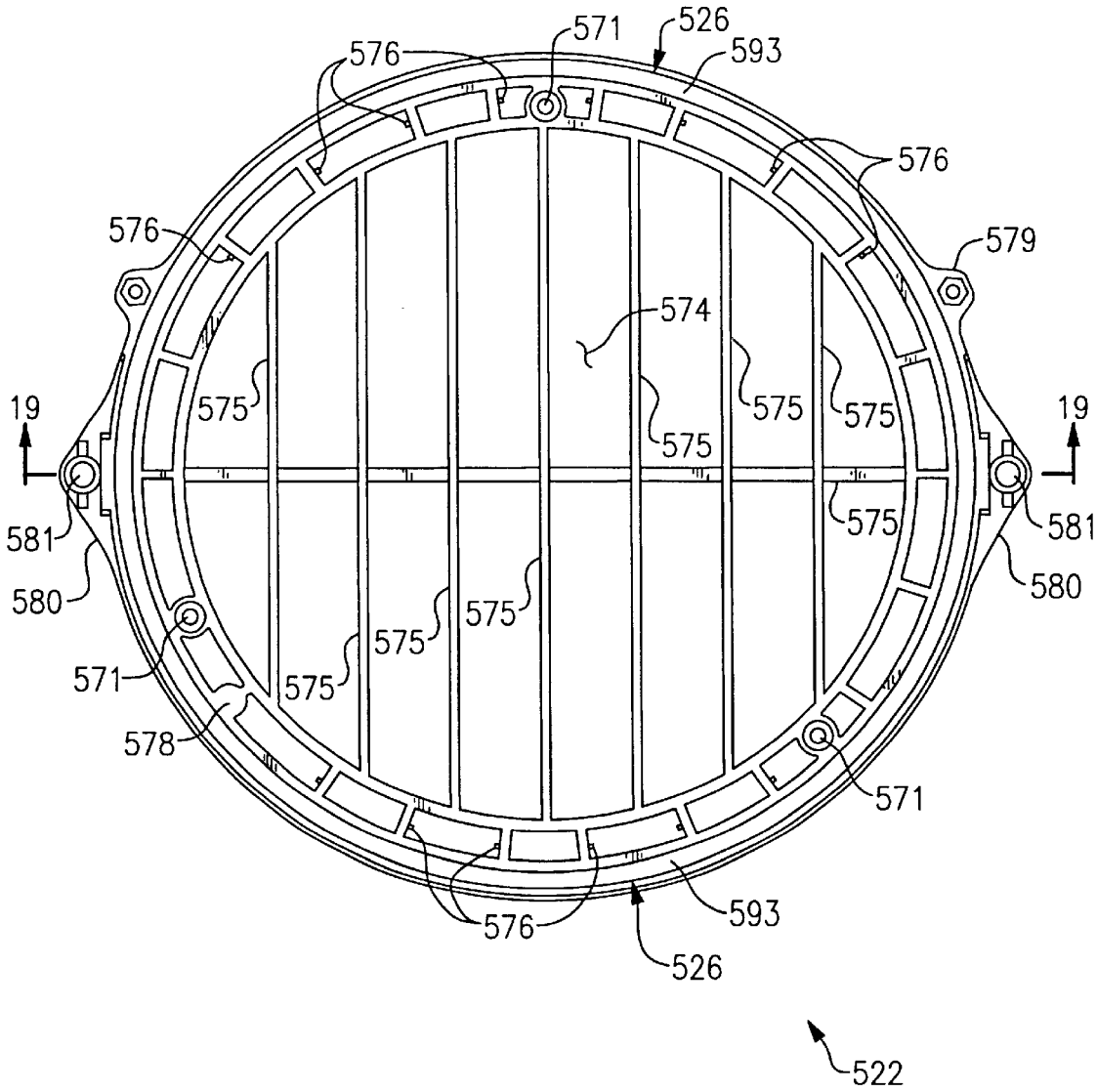
FIG. 17 is a top plan view of the high voltage housing.
Figure 18:
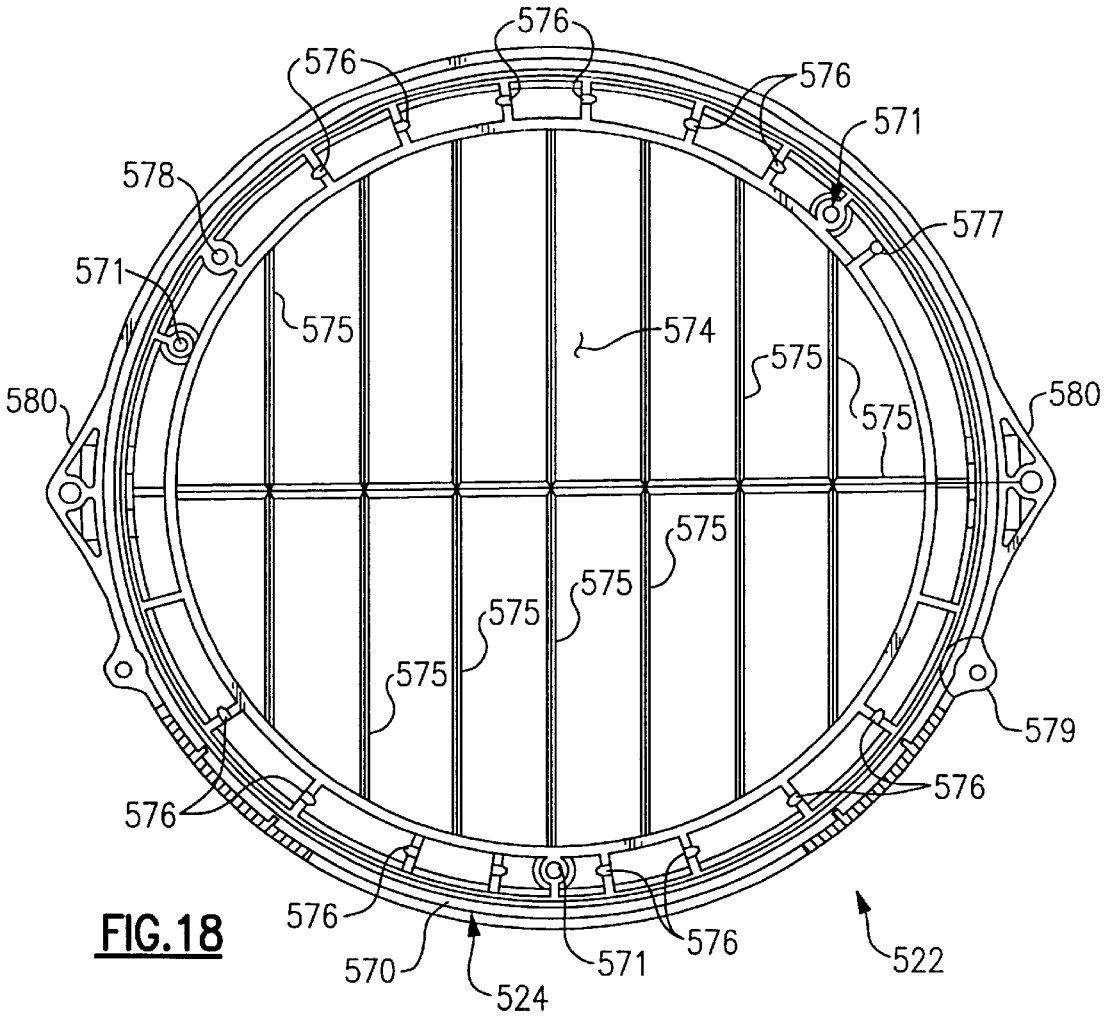
FIG. 18 is a bottom plan view of the high voltage housing.
Figure 19:
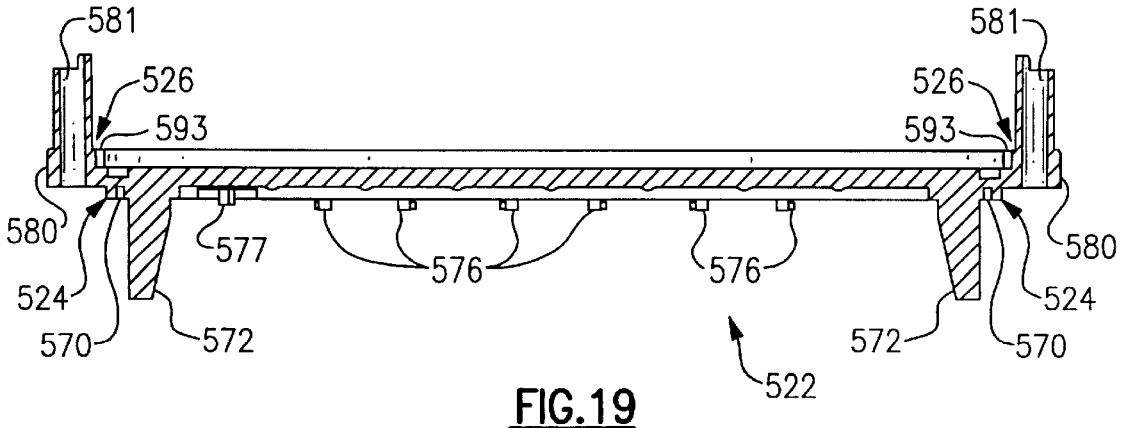
FIG. 19 is a cross section view of the high voltage housing taken along line 19—19 of FIG. 17.
Figure 20:
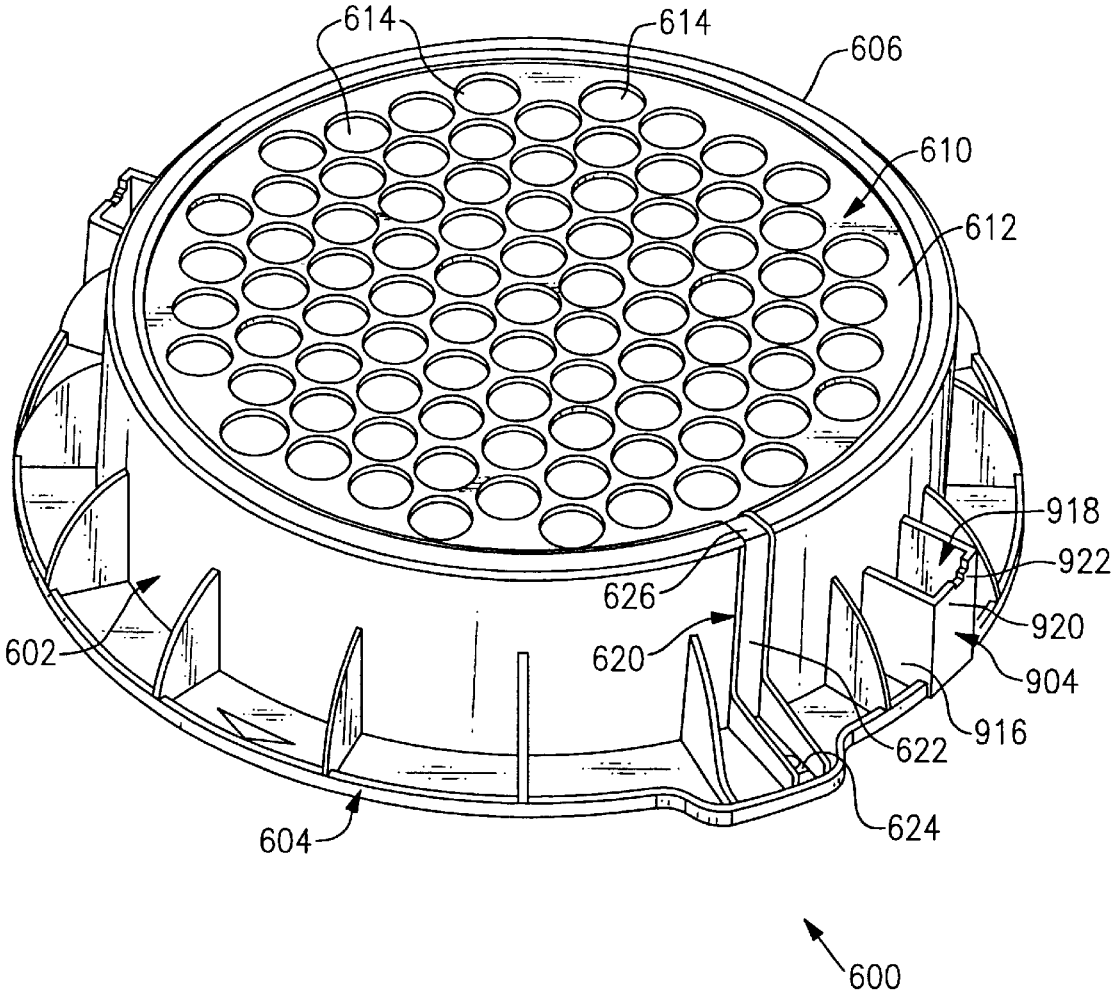
FIG. 20 is a perspective view of the primary filter module.
Figure 21:
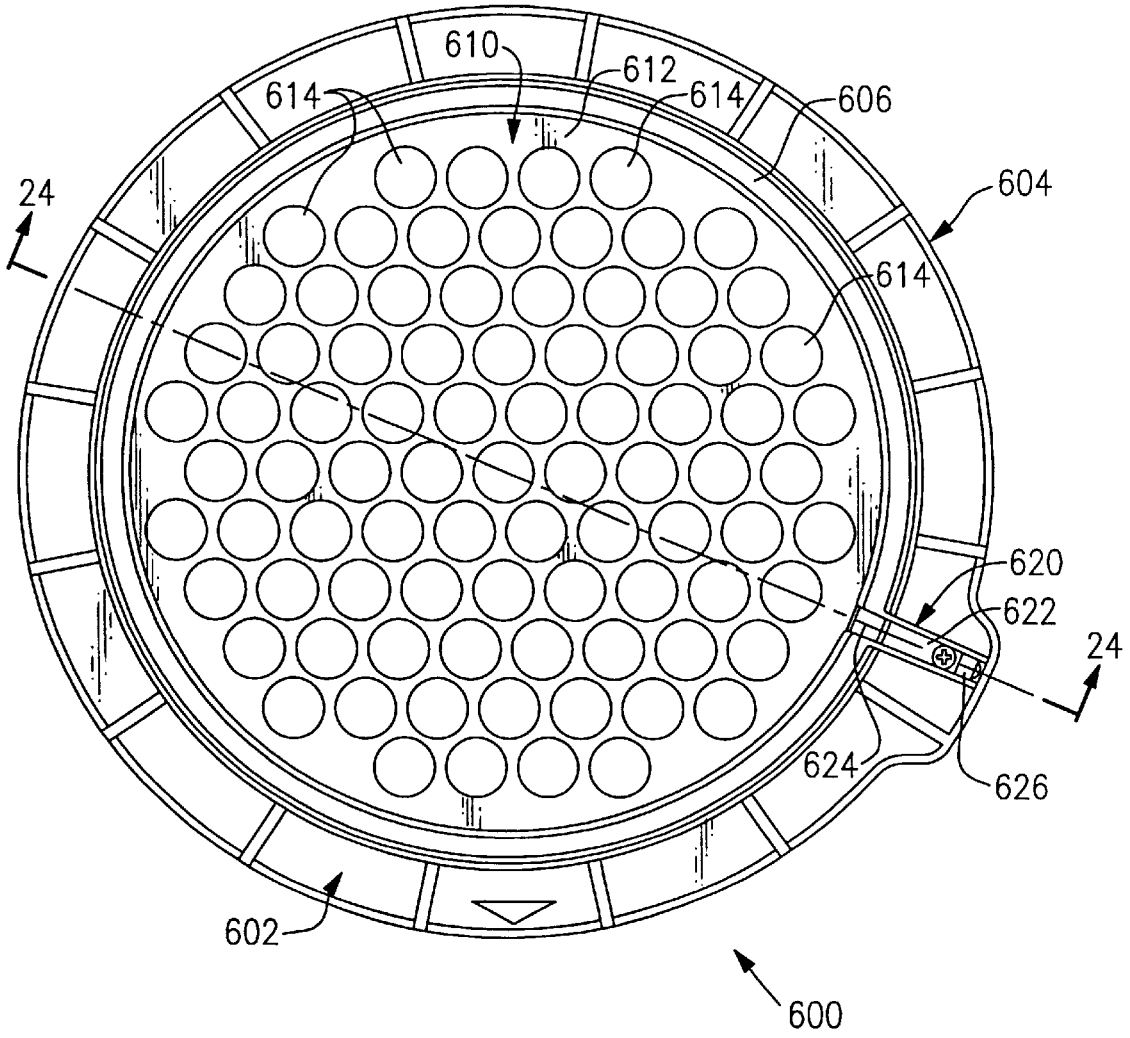
FIG. 21 is a top plan view of the primary filter module.
Figure 22:
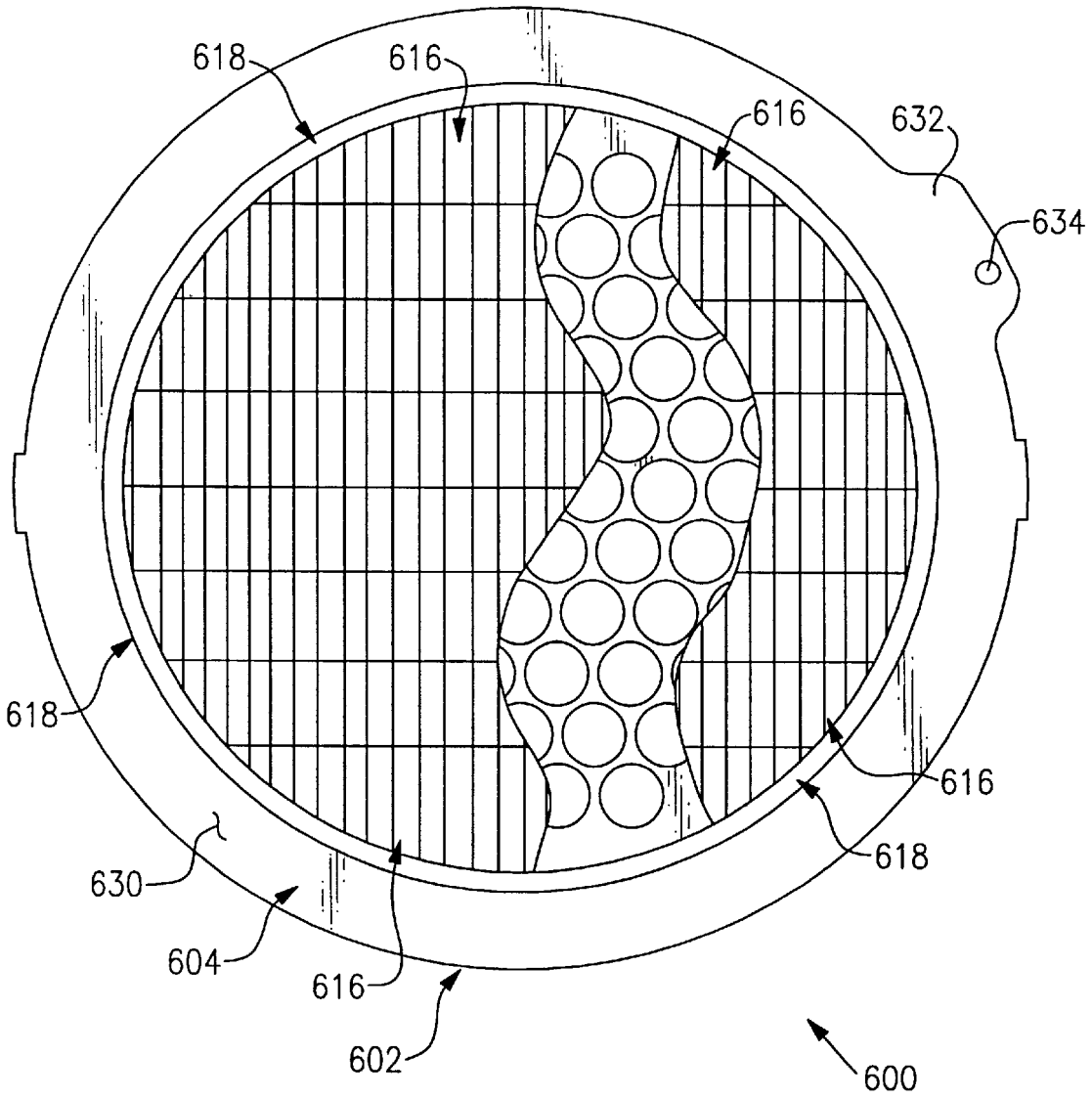
FIG. 22 is a bottom plan view of the primary filter module.
Figure 23:
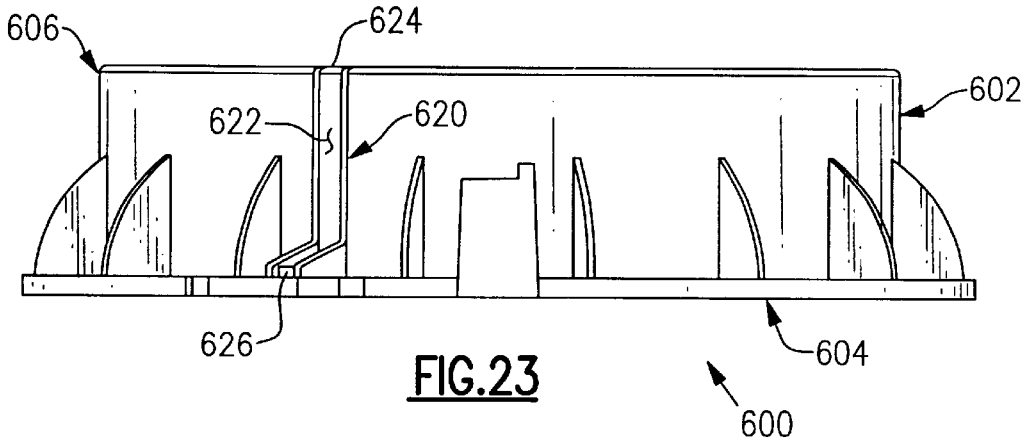
FIG. 23 is a side elevation view of the primary filter module.
Figure 24:
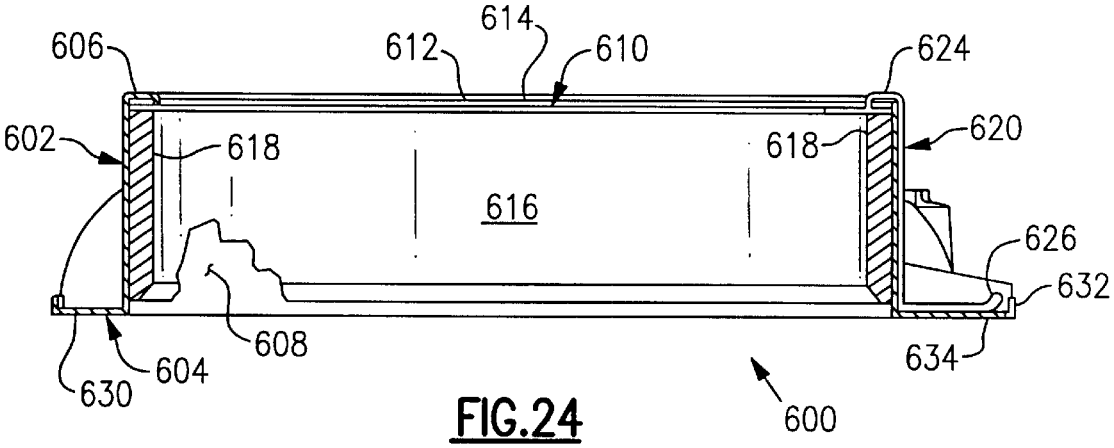
FIG. 24 is a cross section view of the primary filter module taken along line 24—24 of FIG. 21.

Referring to FIGS. 15, 16, and 20, wherein the locking mechanism 900 is shown in greater detail. As described heretofore, the locking mechanism 900 is generally provided to allow the user to securely and removably engage the primary filter module 600 with the ionization module 500 and to allow replacement of the primary filter module 600 when the primary filter indicator 808 indicates that the primary filter module 500 is not working properly. In the embodiment shown, the locking mechanism 900 generally comprises a lever member 902 and a cam member 904. The lever member 904 generally comprises a base portion 906, a handle portion 908, and an engagement or bearing portion 910. The base portion 906 is of cylindrical shape and is rotatably disposed within the upward extending cavity portion 581 of the ionization module 500. The base portion 906 has an end portion 912 that is provided that is retained within the cavity portion 581 by a retaining clip or pin 914. The cam member 904 has a base portion 916 and bearing member 918 which slopes upward from a lower bearing portion 920 to an upper bearing portion 922. Upon engagement of the primary filter module 600 with the ionization module 500, the handle portion 908 may be rotated causing the bearing portion 910 to come in contact with the lowering bearing portion 920 of the cam member 904. Further rotation of the handle portion 908 causes the bearing portion 910 to move from the lower bearing portion 920 to the upper bearing portion 922 and the primary filter module 600 to move downward into secured and sealed engagement with the ionization module 500.

Figure 25:
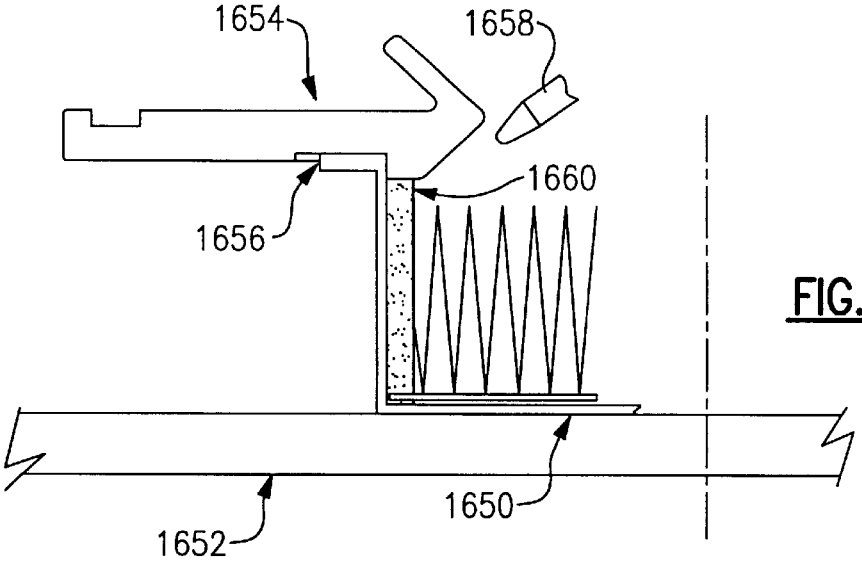
FIG. 25 is an illustrative cross section view of the primary filter module formed by a spin tooling filter sealing process for potting and sealing media within the filter module housing.
Figure 26:
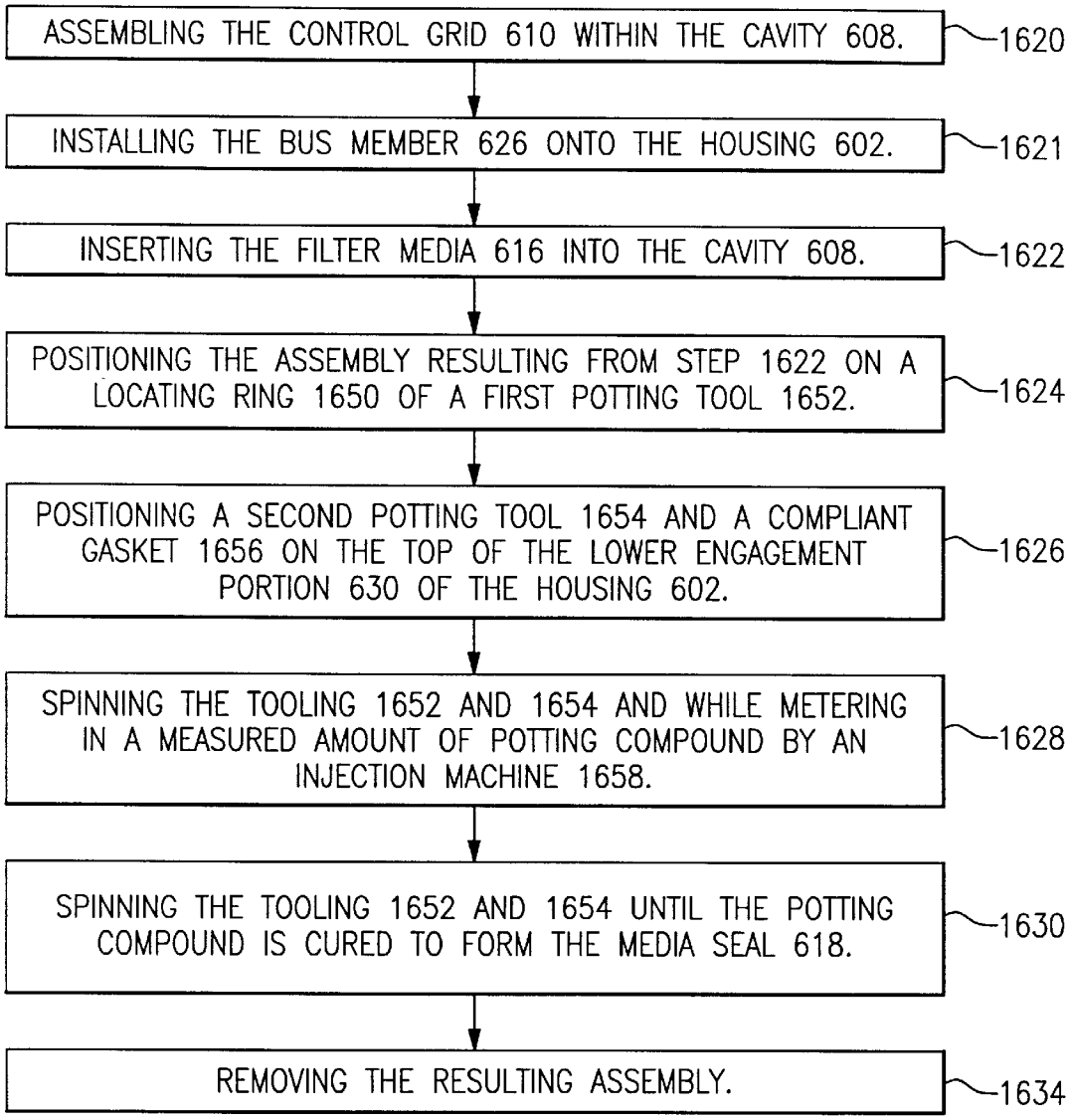
FIG. 26 is a block diagram showing a method of manufacture for the primary filter module.

Referring to FIGS. 25 and 26, where a method for manufacturing the primary filter module 600 is shown. As indicated by a block 1620, the method of manufacture generally comprises a first step of assembling the control grid 610 within the cavity 608 and adding the bus member 620. As shown by block 1622, the method comprises the further step of inserting the filter media 616 into the cavity 608. As shown by block 1624, the method comprises the further step of positioning the assembly resulting from step 1620 on a locating ring 1650 of a first potting tool 1652. As shown by block 1626, the method comprises the further step of positioning a second potting tool 1654 and a compliant gasket 1652 on the top of the lower engagement portion 604 of the housing 602. As shown by block 1628, the method comprises the further step of spinning the tooling 1652 and 1654 and while metering in a measured amount of potting compound or sealing media 1660 by a injection machine 1658. As shown by block 1630, the method comprises the further step of spinning the tooling 1652 and 1654 until the potting compound 1660 is cured thereby forming the sealing member 618. As shown by block 1632, the method comprise the further step of removing the resulting assembly.

Figure 27:
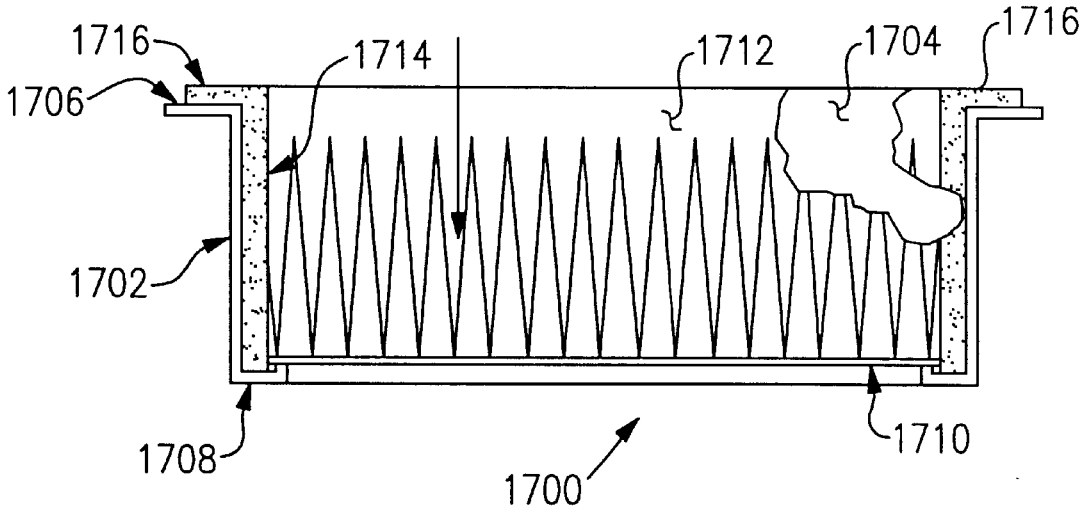
FIG. 27 is an illustrative cross section view of a second embodiment of the primary filter module.

Referring to FIG. 27, wherein a second embodiment of the primary filter module 600 is shown designated as 1700 and generally comprises a housing 1702 having a cavity 1704 and a lower and upper engagement portion 1706 and 1708. The filter module further comprises a control grid 1710 and a filter media 1712 impregnated within the cavity 1704. The impregnation process results in a media seal 1714 between said cavity 1704 and the filter media 1712 and a gasket 1716 thereby causing any contaminated air entering the primary filter module 600 to pass thru the filter media 1712. In the air filtration system 100, the gasket 1716 would replace the need for the sealing member 528. The gasket 1716 would provide sealed engagement between the primary filter module 600 and/or 1700 and the ionization module 500.

Figure 28:
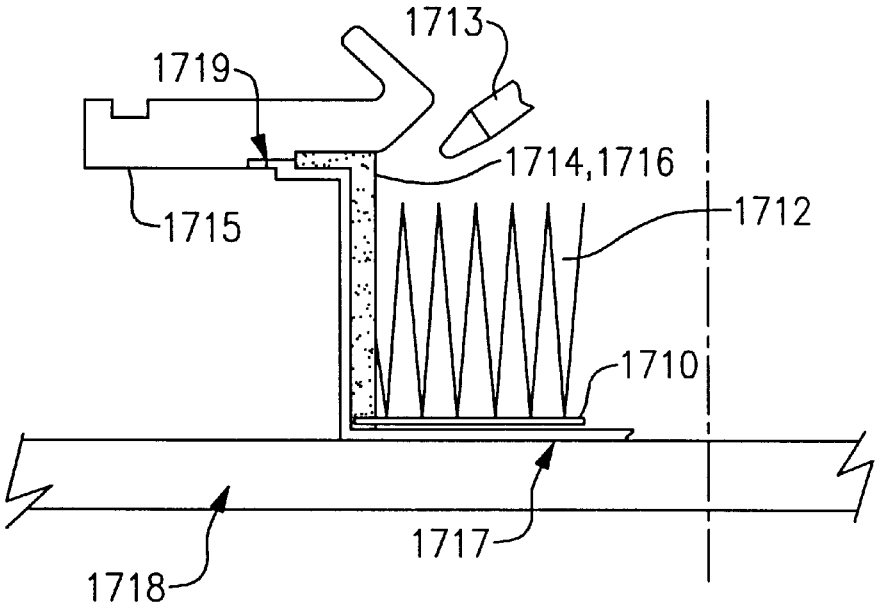
FIG. 28 is an illustrative cross section view of the second embodiment of the primary filter module formed by an injection molding process.
Figure 29:
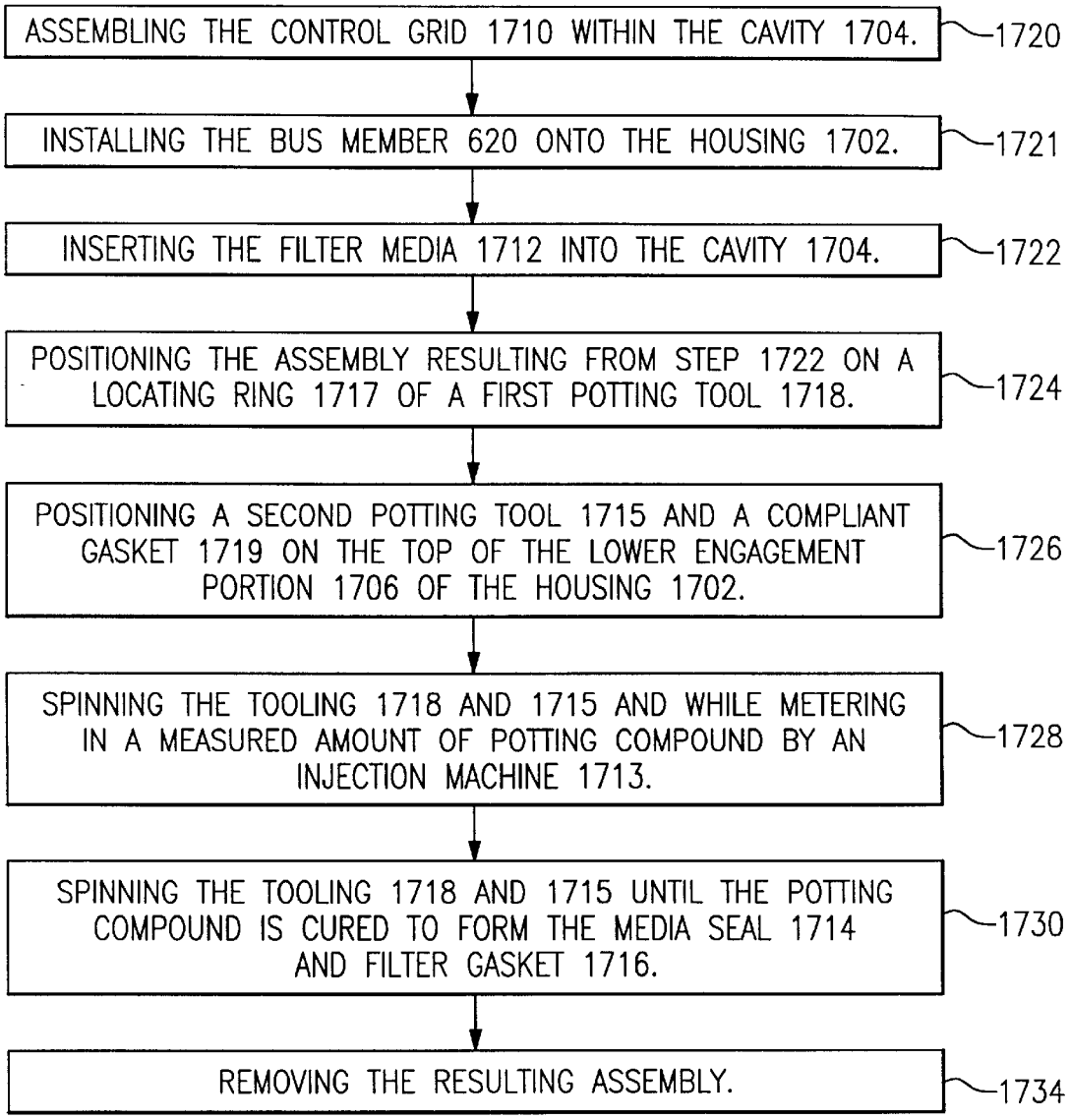
FIG. 29 is a block diagram showing a method of manufacture for the second embodiment of the primary filter module.

Referring to FIGS. 28 and 29, where a method for manufacturing the second embodiment of the primary filter module 1700 is shown. As indicated by a block 1720, the method generally comprises a first step of assembling the control grid 1710 within the cavity 1704 and adding the bus member 620. As shown by block 1722, the method comprises the further step of inserting the filter media 1712 into the cavity 1704. As shown by block 1724, the method comprises the further step of positioning the assembly resulting from step (b) on a locating ring 1717 of a first potting tool 1718. As shown by block 1726, the method comprises the further step of positioning a second potting tool 1715 and a compliant gasket 1719 on the top of the upper engagement portion 1708 of the housing 1702. As shown by block 1728, the method comprises the further step of spinning the tooling 1718 and 1715 while metering in a measured amount of potting compound by an injection machine 1713. As shown by block 1730, the method comprises the further step of spinning the tooling 1718 and 1715 until the potting compound is cured thereby forming the media seal 1714 and filter gasket 1716. As shown by block 1732, the method comprise the further step of removing the resulting assembly.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A portable air filtration system for removing contaminants from room air comprising:

(a) a power supply;

(b) an air blower module electrically connected to said power supply;

(c) an ionization module engaged with said air blower module and comprising a first control grid and a high voltage grid electrically connected to said power supply;

(d) a filter module removably engaged with said ionization module, said filter module comprising a filter and a second control grid, engagement of said filter module and said ionization module creates an electrical connection between said second control grid and said power supply; and (e) whereby activation of the air filtration system creates a first ionization field between said high voltage grid and said first control grid and a second ionization field between said high voltage grid and said second control grid.

2. The air filtration system of claim 1, wherein said ionization module and said filter module each comprise a housing having a lower and upper engagement portion, said lower engagement portion of said filter module is sealably engageable with said upper engagement portion of said ionization module.

3. The air filtration system of claim 2, wherein said upper engagement portion of said ionization module comprises a sealing member.

4. The air filtration system of claim 3, wherein said sealing member is an o-ring.

5. The air filtration system of claim 3, wherein said upper engagement portion of said filter module comprises a substantially planar surface engageable with said sealing member of said ionization module.

6. The air filtration system of claim 2, wherein said filter module comprises a bus member connecting said second control grid to said power supply upon said engagement of said filter module and said ionization module.

7. The air filtration system of claim 6, wherein said bus member is a conductive strip having a first end portion connected to said first control grid and a second end portion electrically connected to said power supply upon said engagement of said filter module and said ionization module.

8. The air filtration system of claim 6, further comprising a locking mechanism engageable with said ionization module and said filter module, said locking mechanism being operable from a first position where said filter module is securely engaged with said ionization module to a second position where said filter module may be disengaged from said ionization module.

9. The air filtration system of claim 8, wherein said locking mechanism comprises a lever portion engaged with said ionization member and a cam portion engaged with said filter unit, said lever portion may be engaged with said cam portion to retain said engagement of said ionization module and said filter module.

10. The air filtration system of claim 8, further comprising electronic circuitry adapted to detect when said high voltage grid is shorted and to generate a first signal indicative that said high voltage grid is non-operational.

11. The air filtration system of claim 10, further comprising a pressure sensor adapted to generate a first signal indicative of a first pressure within said ionization module and said electronic circuitry is adapted to generate a second signal indicative that said filter needs to be replaced in response to said first signal.

12. The air filtration system of claim 1, wherein said first and second control grid each comprise a conductive plate having a plurality of openings.

13. The air filtration system of claim 1, wherein high voltage grid of said ionization module comprises a conductive wire formed in a grid pattern.

14. An air filtration unit for use with an air filtration system having a power supply, the air filtration unit comprising:

(a) an air blower module electrically connected to the power supply;

(b) an ionization module engaged with said air blower module and comprising a first control grid and a high voltage grid electrically connected to the power supply; and (c) a filter module removably engaged with said ionization module, said filter module comprising a filter and a second control grid, engagement of said filter module and said ionization module creates an electrical connection between said second control grid and the power supply.

15. An air filtration unit for use with an air filtration system having a power supply and an air blower unit electrically connected to the power supply, the air filtration unit comprising:

(a) an ionization module engaged with said air blower unit and comprising a high voltage grid connected to the power supply; and (b) a filter module removably engaged with said ionization module, said filter module comprising a filter and a control grid, engagement of said filter module and said ionization module creates an electrical connection between said control grid and the power supply.

16. An air filter module for use with an air filtration system having a power supply and an ionization unit module having a high voltage grid connected to the power supply, the air filter module comprises:

(a) a housing having a cavity portion and a lower engagement portion;

(b) a filter disposed within said housing; and (c) a control grid engaged with said housing;

(d) a bus member electrically connecting said control grid to the power supply upon engagement of said lower engagement portion and the ionization unit module.

* * * * *